US008833585B2

(12) United States Patent
Ramsey et al.

(10) Patent No.: US 8,833,585 B2
(45) Date of Patent: Sep. 16, 2014

(54) RESEALABLE BEVERAGE CAN ENDS

(75) Inventors: Christopher Paul Ramsey, Wantage (GB); Sylvia Maria Farrow, Newbury (GB); Florian Christian Gregory Combe, Oxford (GB); Graham Martin Gossedge, Didcot (GB); Philip Norman Horton, Witney (GB); Andrew Jonathan Sant, Shalbourne (GB)

(73) Assignee: Crown Packaging Technology, Inc., Alsip, IL (US)

( * ) Notice: Subject to any disclaimer, the term of this patent is extended or adjusted under 35 U.S.C. 154(b) by 707 days.

(21) Appl. No.: 12/470,909

(22) Filed: May 22, 2009

(65) Prior Publication Data

US 2010/0294768 A1 Nov. 25, 2010

(51) Int. Cl.

| | |
|---|---|
| ***B65D 17/34*** | (2006.01) |
| ***B65D 51/18*** | (2006.01) |
| ***B65D 17/50*** | (2006.01) |
| ***B65D 17/00*** | (2006.01) |

(52) U.S. Cl.

CPC ..... *B65D 17/166* (2013.01); *B65D 2517/0031* (2013.01)

USPC ..... 220/254.3; 220/254.9; 220/259.1; 220/269

(58) Field of Classification Search

USPC ..... 220/254.9, 259.1, 258.2, 255.1, 254.3, 220/254.4, 269, 240

See application file for complete search history.

(56) References Cited

U.S. PATENT DOCUMENTS

| | | | | |
|---|---|---|---|---|
| 3,250,425 | A | | 5/1966 | Stec et al. |
| 3,262,612 | A | | 7/1966 | Tabor |
| 3,269,168 | A | | 8/1966 | Anderson |
| 3,287,053 | A | * | 11/1966 | Stec ..... 292/256.63 |
| 3,386,613 | A | | 6/1968 | Traynor |
| 3,406,867 | A | | 10/1968 | Westphal et al. |
| 3,447,713 | A | | 6/1969 | Stec et al. |

(Continued)

FOREIGN PATENT DOCUMENTS

| | | |
|---|---|---|
| EP | 0088185 A1 | 9/1983 |
| EP | 0305598 A1 | 3/1989 |

(Continued)

OTHER PUBLICATIONS

U.S. Appl. No. 12/447,576, filed Apr. 28, 2009, Paris.

(Continued)

*Primary Examiner* — Mickey Yu
*Assistant Examiner* — Chun Cheung
(74) *Attorney, Agent, or Firm* — Baker & Hostetler LLP

(57) ABSTRACT

A can end combination, a resealable beverage can, and a method of sealing a beverage can are disclosed. The can end combination may include a metal can end and a resealable closure coupled to the can end. The can end may include a center panel having an aperture formed therethrough. The closure may include a base plate and a top plate coupled to the base plate. The closure may have a sealed position in which the base plate contacts the center panel about the aperture to form at least one of a bore seal and a face seal. The closure may also have an intermediate position in which the base plate is proximate the aperture but the closure is devoid of the bore seal and the face seal. The closure may also have a fully open position in which the aperture is exposed to enable pouring liquid through the aperture.

14 Claims, 12 Drawing Sheets

(56) References Cited

U.S. PATENT DOCUMENTS

| | | | | |
|---|---|---|---|---|
| 3,450,301 | A | 6/1969 | Stec et al. | |
| 3,520,440 | A | 7/1970 | Kinnavy et al. | |
| 3,622,034 | A | 11/1971 | Lutzker et al. | |
| 3,705,670 | A | 12/1972 | Douty | |
| 3,741,141 | A | 6/1973 | Diekhoff et al. | |
| 3,744,662 | A | 7/1973 | Zundel | |
| 3,788,512 | A | 1/1974 | Brahler | |
| 3,871,314 | A | 3/1975 | Stargell | |
| 3,871,544 | A | 3/1975 | Peyser | |
| 3,910,410 | A | 10/1975 | Shaw | |
| 3,952,911 | A | 4/1976 | Bozek et al. | |
| 4,054,205 | A | 10/1977 | Blow, Jr. et al. | |
| 4,098,439 | A | 7/1978 | Blow, Jr. et al. | |
| 4,122,970 | A | 10/1978 | Amabili | |
| 4,127,221 | A | 11/1978 | Vere | |
| 4,136,797 | A | 1/1979 | Potts | |
| 4,150,777 | A | 4/1979 | Cyr et al. | |
| 4,266,688 | A | 5/1981 | Reid | |
| 4,361,244 | A | 11/1982 | Walter | |
| 4,369,888 | A | 1/1983 | Walter | |
| 4,386,713 | A | 6/1983 | Baumeyer et al. | |
| 4,397,400 | A * | 8/1983 | Walter | 220/259.2 |
| 4,397,403 | A | 8/1983 | Guimarin | |
| 4,407,423 | A | 10/1983 | Walter | |
| 4,431,110 | A | 2/1984 | Roth | |
| 4,440,310 | A | 4/1984 | Heyn | |
| 4,462,504 | A | 7/1984 | Roth et al. | |
| 4,540,611 | A | 9/1985 | Henderson | |
| 4,576,306 | A | 3/1986 | Kelsey et al. | |
| 4,681,238 | A | 7/1987 | Sanchez | |
| 4,746,032 | A | 5/1988 | Huang | |
| 4,783,985 | A | 11/1988 | LaBarge et al. | |
| 4,821,912 | A | 4/1989 | Wells | |
| 4,915,290 | A | 4/1990 | Robichaud et al. | |
| 4,930,654 | A | 6/1990 | Thibeault et al. | |
| 4,951,835 | A | 8/1990 | DeMars et al. | |
| 5,085,338 | A | 2/1992 | Inagaki | |
| 5,148,935 | A | 9/1992 | Lyon | |
| 5,199,591 | A | 4/1993 | Thibeault et al. | |
| 5,199,618 | A | 4/1993 | Reil et al. | |
| 5,242,073 | A | 9/1993 | Willis et al. | |
| 5,335,808 | A | 8/1994 | Lee | |
| 5,351,853 | A | 10/1994 | Shock | |
| 5,622,273 | A | 4/1997 | Kelly | |
| 5,692,633 | A | 12/1997 | Gordon | |
| 5,711,447 | A | 1/1998 | Plester | |
| 5,813,561 | A | 9/1998 | Chang et al. | |
| 5,829,610 | A | 11/1998 | Rohr | |
| 5,851,685 | A | 12/1998 | McEldowney | |
| 5,947,317 | A | 9/1999 | Hall | |
| 6,065,634 | A | 5/2000 | Brifcani et al. | |
| 6,105,806 | A | 8/2000 | Stasiuk | |
| 6,581,264 | B2 * | 6/2003 | Ohori et al. | 29/426.1 |
| 6,588,617 | B1 | 7/2003 | Majcen et al. | |
| 6,626,314 | B1 | 9/2003 | McHenry et al. | |
| 6,763,963 | B1 | 7/2004 | Martin | |
| 7,152,766 | B1 | 12/2006 | Walsh et al. | |
| 7,168,586 | B2 | 1/2007 | Jeon | |
| 7,198,168 | B2 | 4/2007 | Mizuma | |
| 7,677,404 | B2 | 3/2010 | McEldowney et al. | |
| 7,921,538 | B2 | 4/2011 | Denslow | |
| 8,240,498 | B2 | 8/2012 | Ramsey et al. | |
| 8,272,532 | B2 * | 9/2012 | Michaelian et al. | 220/715 |
| 2002/0050493 | A1 | 5/2002 | Ball et al. | |
| 2003/0062370 | A1 | 4/2003 | Ball et al. | |
| 2003/0178433 | A1 | 9/2003 | Adams | |
| 2005/0051553 | A1 | 3/2005 | Li et al. | |
| 2005/0115977 | A1 * | 6/2005 | Dibdin et al. | 220/714 |
| 2005/0150889 | A1 | 7/2005 | Perra | |
| 2005/0173453 | A1 | 8/2005 | Azodi | |
| 2006/0163253 | A1 | 7/2006 | Steadman | |
| 2007/0068943 | A1 | 3/2007 | Ramsey | |
| 2007/0145055 | A1 | 6/2007 | Gardiner | |
| 2007/0164026 | A1 | 7/2007 | Morrissey | |
| 2007/0215620 | A1 | 9/2007 | Kasper | |
| 2007/0262079 | A1 | 11/2007 | Paris | |
| 2008/0053997 | A1 | 3/2008 | Perra | |
| 2008/0110887 | A1 | 5/2008 | Ramsey | |
| 2008/0314904 | A1 | 12/2008 | Perra | |
| 2009/0001081 | A1 | 1/2009 | Schlattl et al. | |
| 2009/0173737 | A1 | 7/2009 | Ramsey | |
| 2009/0179033 | A1 | 7/2009 | Ramsey | |

FOREIGN PATENT DOCUMENTS

| | | | |
|---|---|---|---|
| EP | 0828663 | B1 | 12/1999 |
| EP | 1767464 | | 3/2007 |
| FR | 1434827 | A | 6/1966 |
| GB | 2154561 | A | 9/1985 |
| GB | 2320008 | A | 6/1998 |
| JP | 61-48128 | | 5/1994 |
| JP | 2003-054549 | | 2/2003 |
| JP | 2003-112735 | | 4/2003 |
| KR | 2000-17742 | A | 4/2000 |
| NL | 2000219 | C2 | 3/2008 |
| NL | 2000994 | C2 | 5/2009 |
| WO | WO 91/10600 | | 7/1991 |
| WO | WO 95/04709 | | 2/1995 |
| WO | WO 96/09968 | | 4/1996 |
| WO | WO 98/36987 | | 8/1998 |
| WO | WO 01/28875 | A1 | 4/2001 |
| WO | WO 02/00512 | | 1/2002 |
| WO | WO 03/062084 | | 1/2003 |
| WO | WO 2007/039367 | A1 | 4/2007 |
| WO | WO 2007/128810 | | 11/2007 |
| WO | WO 2008/068169 | | 6/2008 |
| WO | WO 2008/054636 | | 7/2008 |
| WO | WO 2009/062004 | | 5/2009 |

OTHER PUBLICATIONS

Amtsblatt des Kantons Graubünden, "Hinged, resealable closures for metal can ends", 1996, 2746-2747.
U.S. Appl. No. 11/503,087: Final Rejection, Nov. 2, 2009.
U.S. Appl. No. 11/503,087: Non-Final Rejection, Jan. 22, 2009.
U.S. Appl. No. 11/591,041: Non-Final Rejection, Dec. 23, 2009.
U.S. Appl. No. 11/591,041: Requirement for Restriction/Election, Sep. 2, 2009.
U.S. Appl. No. 11/747,049: Non-Final Rejection, Sep. 15, 2009.
English Translation of Abstract of JP 2003-112735, published on Apr. 18, 2003.
English Translation of Abstract of JP 2003-054549, published on Feb. 26, 2003.
English Translation of Abstract of JP 61-48128, published on May 27, 1994.

* cited by examiner

RESEALABLE BEVERAGE CAN ENDS

CROSS-REFERENCE TO RELATED APPLICATIONS

This application is related by subject matter to U.S. patent application Ser. No. 12/267,159, filed on Nov. 7, 2008 and entitled "Resealable Beverage Can End and Methods Relating to Same," which is herein incorporated by reference in its entirety.

TECHNICAL FIELD

The present invention relates to packaging for cans and, more particularly, to a resealable beverage can end, a resealable closure, and methods of their use.

BACKGROUND

The structure and functionality of commercial beverage cans have been optimized over the years. Yet commercial beverage cans have the drawback of being unable to reclose after initial opening. Reclosing beverage cans is made more difficult by the dissolved carbon dioxide or other gases in a carbonated beverage that leaves the solution and tends to increase the pressure in the headspace. Several resealable can end designs have been proposed by the prior art, but none have reached commercial acceptance. Consumers of beverages in plastic bottles, on the other hand, often reseal the bottle by screwing its threaded closure onto the bottle finish. This attribute appeals to consumers. Accordingly, there is a need for a resealable beverage can that is easy or intuitive to use, has a viable cost, and is not overly complex.

SUMMARY

The inventors have developed improvements to resealable beverage can ends, such as (for example) the reclosable can ends disclosed in the present assignee's co-pending U.S. patent application Ser. No. 12/267,159. For example it may be desirable to reduce the force required for a user to reclose or reseal the closure, improve the ability of the closure to maintain a seal and to withstand leaks, and/or provide a closure that is universal to different can ends.

A recloseable beverage can end according to the invention may provide the ability to store a portion of the beverage for later use, security, cleanliness, and maintenance of the carbonation level of the beverage even if the beverage is intended to be consumed in one sitting. The recloseable beverage can end may also provide confidence to a user that the beverage can has been properly re-closed, maintenance of the carbonation level of the beverage, and security against spills if the re-closed beverage can is tilted or jostled, for example, placed in a bag. Accordingly, a can end combination, a resealable beverage can, and a method of sealing a beverage can are provided that may provide one or more of the above identified features.

Improved resealable can end combinations are disclosed. In one embodiment the combination may include a metal can end and a resealable closure. The metal can end may have a peripheral wall and a center panel that has an upper surface, an opposing lower surface, and an edge formed into a curl that defines an aperture through the center panel. The resealable closure may be coupled to the can end and may include a base plate and a top plate assembly coupled to the base plate. The base plate may include a circumferential flange, a ring extending upwardly from the flange, and a bead extending around an outboard side of the ring. The closure has a sealed position in which the base plate contacts the center panel about the aperture and the curl forms at least one of a bore seal and a face seal, and a bead seal with the bead. The closure has an intermediate position in which the base plate is proximate the aperture but the closure is devoid of the bore seal, the face seal and the bead seal. The closure also has a fully open position in which the aperture is exposed to enable pouring liquid through the aperture.

The base plate may further include a fin, and the face seal may be formed between the curl and the fin when the closure is in the sealed position.

In another embodiment the combination may include a metal can end and a resealable closure. The metal can end may have a peripheral wall and a center panel that has an upper surface, an opposing lower surface, and an edge formed into a curl that defines an aperture through the center panel. The resealable closure may be coupled to the can end and may include a base plate and a top plate assembly coupled to the base plate. The base plate may include a circumferential flange, a plate member, a ring extending from a periphery of the plate member and flexing about an anchor point located proximate to the periphery of the plate member, and a bead extending around an outboard side of the ring. The closure has a sealed position in which the base plate contacts the center panel about the aperture and the curl forms at least one of a bore seal and a face seal, and a bead seal with the bead. The closure has an intermediate position in which the base plate is proximate the aperture but the closure is devoid of the bore seal, the face seal and the bead seal. The closure also has a fully open position in which the aperture is exposed to enable pouring liquid through the aperture.

In another embodiment the combination may include a metal can end and a resealable closure. The metal can end may have a peripheral wall and a center panel that has an upper surface, an opposing lower surface, and an edge formed into a curl that defines an aperture through the center panel. The resealable closure may be coupled to the can end and may include a base plate and a top plate assembly coupled to the base plate. The base plate may include an elastomeric portion. The closure has a sealed position in which the base plate contacts the center panel about the aperture such that the elastomeric portion is at least partially compressed and the curl forms at least one of a bore seal and a face seal. The closure has an intermediate position in which the base plate is proximate the aperture but the closure is devoid of the bore seal, and the face seal. The closure also has a fully open position in which the aperture is exposed to enable pouring liquid through the aperture.

In another embodiment the combination may include a metal can end and a resealable closure. The metal can end may have a peripheral wall and a center panel that has an upper surface, an opposing lower surface, and an edge formed into a curl that defines an aperture through the center panel. The resealable closure may be coupled to the can end and may include a base plate and a top plate assembly coupled to the base plate. The base plate may include a circumferential flange near its periphery and one or more ring portions extending up from the flange. The closure has a sealed position in which the base plate contacts the center panel about the aperture and the curl forms a face seal with the flange and a bore seal with each of the ring portions. The closure has an intermediate position in which the base plate is proximate the aperture but the closure is devoid of the bore seals, and the face seal. The closure also has a fully open position in which the aperture is exposed to enable pouring liquid through the aperture.

In another embodiment the combination may include a metal can end and a resealable closure. The metal can end may have a peripheral wall and a center panel that has an upper surface, an opposing lower surface, and an edge formed into a curl that defines an aperture through the center panel. The resealable closure may be coupled to the can end and may include a base plate and a top plate assembly coupled to the base plate. The base plate may include a circumferential flange near its periphery and a ring extending up from the flange. The top plate assembly may include a tab having a through hole that is of a sufficient size to accommodate insertion of a user's finger. The closure has a sealed position in which the base plate contacts the center panel about the aperture and the curl forms a face seal with the flange and a bore seal with each of the ring portions. The closure has an intermediate position in which the base plate is proximate the aperture but the closure is devoid of the bore seals, and the face seal. The closure also has a fully open position in which the aperture is exposed to enable pouring liquid through the aperture. The face seal may be de-energized upon initial contact between the curl and flange and there is no gas pressure pushing the flange against the curl. The face seal may be energized when the closure is in the sealed position and gas pressure pushes the flange upward against the curl. The tab through hole may enable gripping by the user to enhance energizing of the face seal.

In another embodiment the combination may include a metal can end and a resealable closure. The metal can end may have a peripheral wall and a center panel that has an upper surface, an opposing lower surface, and an edge formed into a curl that defines an aperture through the center panel. The resealable closure may be coupled to the can end and may include a base plate and a top plate assembly coupled to the base plate. The base plate may include a circumferential flange near its periphery, a ring extending up from the flange, and a bore groove formed in the flange proximate to the ring. The closure has a sealed position in which the base plate contacts the center panel about the aperture and the curl forms a face seal with the flange and a bore seal with the ring, the bore groove being between the bore seal and the face seal. The closure has an intermediate position in which the base plate is proximate the aperture but the closure is devoid of the bore seal, and the face seal. The closure also has a fully open position in which the aperture is exposed to enable pouring liquid through the aperture.

In another embodiment the combination may include a metal can end and a resealable closure. The metal can end may have a peripheral wall and a center panel that has an upper surface, an opposing lower surface, and a plastic portion that defines an aperture through the center panel. The resealable closure may be coupled to the can end and may include a base plate and a top plate assembly coupled to the base plate. The base plate may include a circumferential flange near its periphery, and a ring extending up from the flange. The closure has a sealed position in which the base plate contacts the center panel about the aperture and the plastic portion forms at least one of a face seal with the flange, and a bore seal with the ring. The closure has an intermediate position in which the base plate is proximate the aperture but the closure is devoid of the bore seal, and the face seal. The closure also has a fully open position in which the aperture is exposed to enable pouring liquid through the aperture.

BRIEF DESCRIPTION OF THE DRAWINGS

The present technology provides a recloseable end for a beverage can and related methods for making and using the recloseable end. The technology will now be described in more detail, by way of example only, with reference to the accompanying drawings, in which.

DETAILED DESCRIPTION OF ILLUSTRATIVE EMBODIMENTS

The present invention provides a recloseable end for a beverage can and related methods for making and using the recloseable end. The embodiments described below illustrate several aspects of the present inventions and are not intended to be limiting.

Figure 1A:
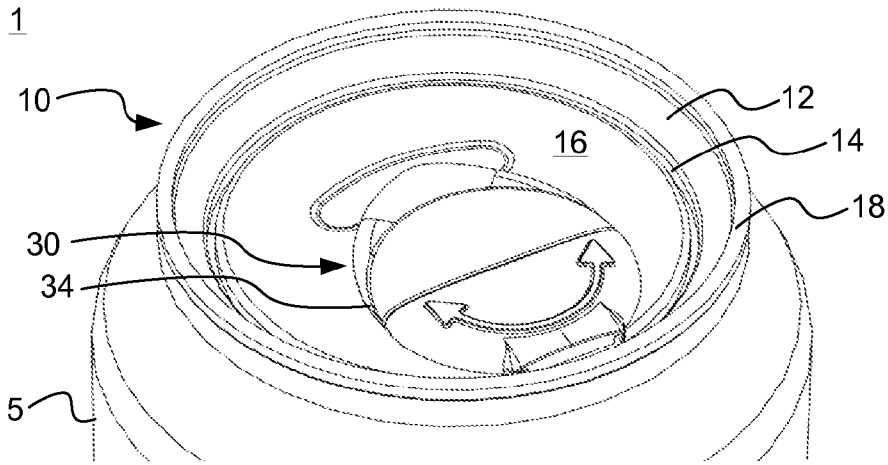
FIG. 1A is a perspective view of a combination can end and a resealable closure illustrating a first embodiment in the fully closed position.
Figure 1B:
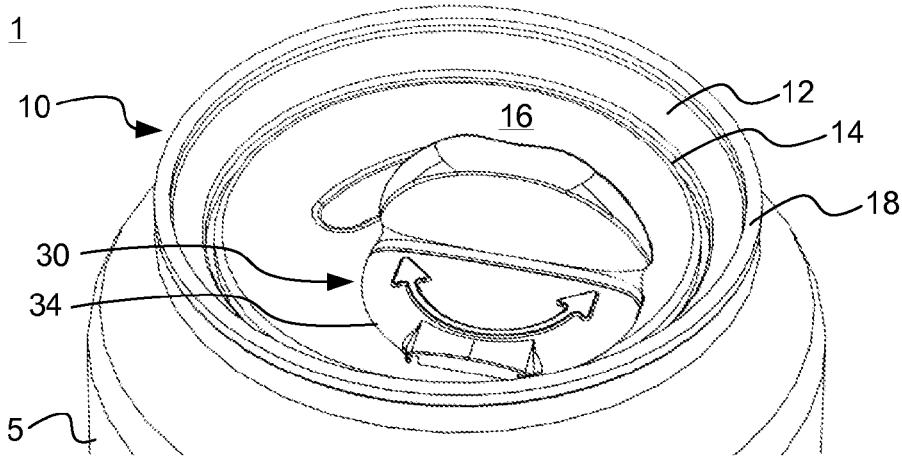
FIG. 1B is a perspective view of the first embodiment in an intermediate position.
Figure 1C:
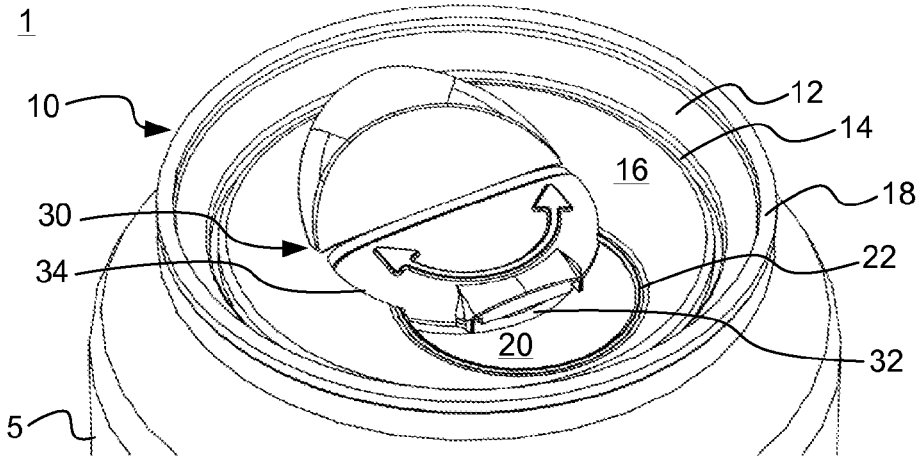
FIG. 1C is a perspective view of the first embodiment in the fully open position.
Figure 3A:
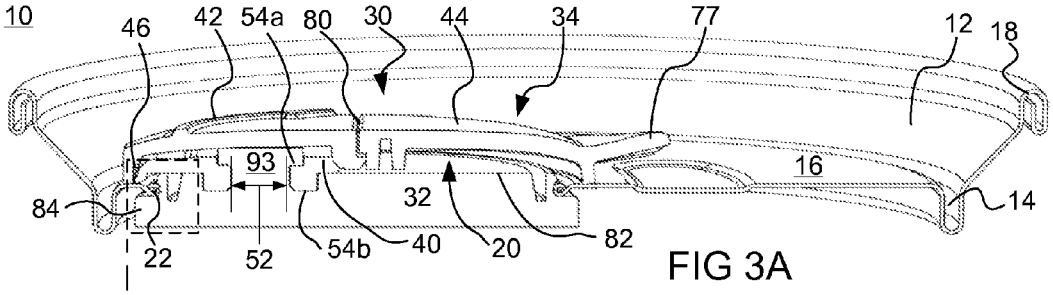
FIG. 3A is a cross sectional view of the first embodiment of the can end in the fully closed position.

Referring to FIGS. 1A-1C, a recloseable beverage can 1 includes a conventional, hollow body 5 and a recloseable can end 10. Recloseable can end 10 includes a peripheral wall 12, a countersink 14 at the base of wall 12, a center panel 16, and a closure 30. The present invention encompasses both unseamed can ends and can ends seamed onto a beverage can body. Accordingly, can end 10 is shown formed into the shape of a double seam 18 (detail is shown in FIG. 3A), which double seam may be conventional. Preferably, can end 10 is made of conventional end stock material of conventional thickness.

Figure 3D:
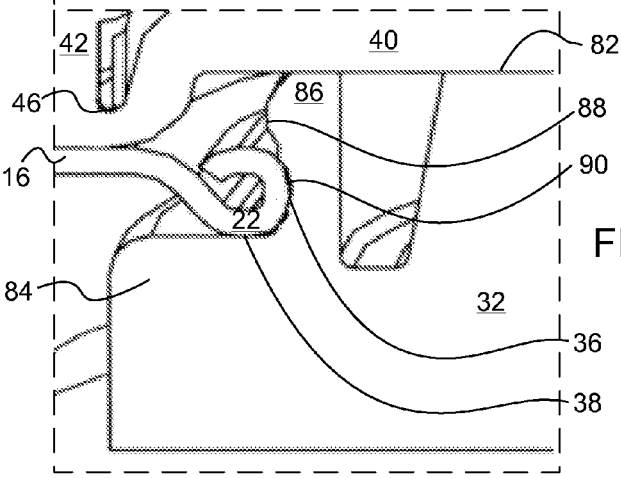
FIG. 3D is an enlarged view of a portion of FIG. 3A depicting a sealing portion of the can end.

As shown in FIG. 1C, can end 10 also includes an aperture 20 formed in center panel 16. The edge that forms aperture 20 preferably is formed into a curl 22 (shown in FIGS. 3A and 3D). Aperture 20 is shown in the figures as circular and located in the center panel 16 in approximately the same location as the opening in a conventional beverage can end. The present invention, however, is not limited to such configuration. For example, the center panel may be formed to have a dome, in which the center panel is domed prior to forming the curl. By having a center panel that is domed, deformation may be reduced when the end is subsequently pressurized, thus the seals (such as the bore, face, and bead seals) may have to move less in order to stay in contact with the curl.

First embodiment closure 30 includes a base plate 32 and a top plate assembly 34. As explained more fully below with reference to FIG. 3D, closure 30 is mounted onto can end 10 such that closure 30 forms a bore seal 36 and a face seal 38 with the curl 22 around the periphery of the aperture 20.

Figure 2A:
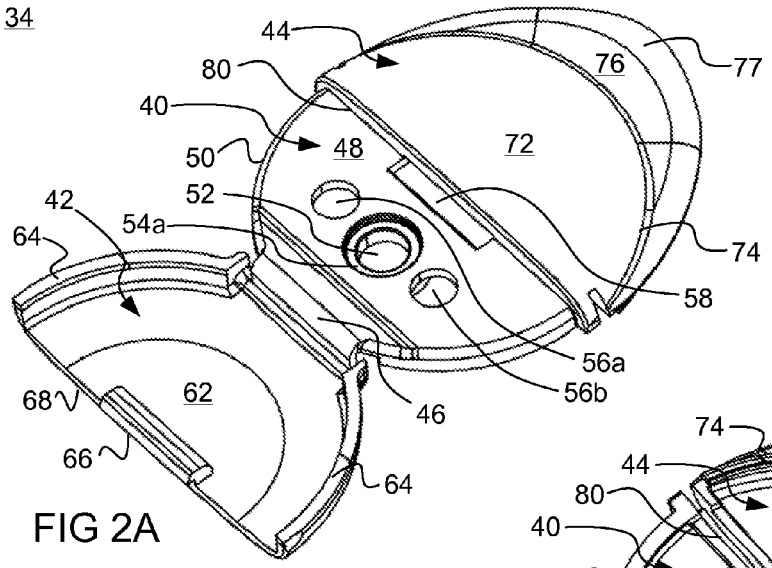
FIG. 2A is a top perspective view of the top plate of the closure of the first embodiment in its pre-assembled state.
Figure 2B:
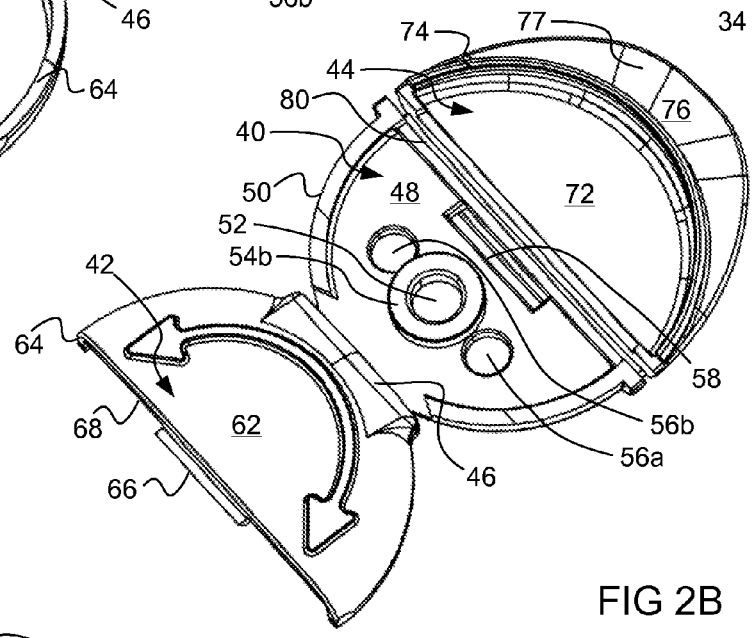
FIG. 2B is a bottom perspective view of the top plate of the first embodiment in its pre-assembled state.

Referring now to FIGS. 2A and 2B, which show a first embodiment of top plate assembly 34, top plate assembly 34 includes an anchor plate 40 that is located between a cover plate 42 and a tab plate 44. A hinge 46 connects anchor plate 40 to cover plate 42. Preferably, top plate assembly 34 is formed of a commercially available thermoplastic that can be injection molded in a unitary piece, as understood by people familiar with packaging technology.

Anchor plate 40 includes a structural portion or deck 48, which preferably is planar or nearly planar, and a skirt 50 that extends downwardly from the periphery of the sides of deck 48. A stake or rivet aperture 52 is formed in deck 48. Deck 48 also includes a groove or seat 54*a* extending around the circumference of aperture 52 on its topside (shown in FIG. 2A) and a ring 54*b* extending around the circumference of aperture 52 on its underside (shown in FIG. 2B). A pair of post apertures 56*a* and 56*b* are formed in deck 48 and located on opposing sides of rivet aperture 52. Preferably post apertures 56*a* and 56*b* extend through deck 48. An opening or slot 58 is formed in deck 48 near an end thereof.

Cover plate 42 includes a structural portion or dome plate 62, which preferably is semi-circular and includes a skirt 64 about its periphery on its opposing sides. Skirt 64 has a cutout to accommodate hinge 46 that connects cover plate 42 to anchor plate 40. An elongated tab 66, which preferably has barbs for insertion into and retention by slot 58, extends from the underside of the surface of plate 62 near an edge opposite of hinge 46. Optionally, a double ended arrow indicator (shown in FIG. 2B) may be formed on the topside of plate 62 to indicate an aspect of the function or step for operating closure 30, such as that required for venting, for example.

Tab plate 44 includes a structural portion or dome plate 72, which preferably is semi-circular and includes a skirt 74 about its periphery. An arcuate extension 76 extends outwardly from a distal end of dome plate 72 and skirt 74, and a tab 77 is formed in extension 76. Tab 77 may be rigid relative to tab plate 44, as shown in FIGS. 2A and 2B. Alternatively, tab 77 may be formed in extension 76 and hinged to dome plate 72 or skirt 74.

Tab plate 44 includes a weakening or groove 80 formed therein, preferably near anchor plate 40 and near the geometric centerline of closure 30. A shoulder, which in the first embodiment is formed by one of the walls forming groove 80, is located between dome plates 62 and 72 of the tab plate 44 and anchor plate 40. In its as-molded, pre-installed position, and in its initial, installed state (that is, before initial opening of closure 30), weakening or groove 80 preferably is not visible when closure 30 is viewed from above, and weakening or groove 80 acts as a living hinge upon actuation of closure 30, as explained more fully below.

When top plate assembly 34 is installed into a can end 10, cover plate 42 is pivoted from its as-molded or pre-installed position (shown in FIGS. 2A and 2B), relative to anchor plate 40 about hinge 46 such that cover plate 42 is located over anchor plate 40. In its installed position (shown in FIG. 3A), dome plate 72 of tab plate 44 and dome plate 62 of cover plate 42 are oriented to align such that a peripheral edge 68 of cover plate 42 is near or abuts the shoulder or adjacent edge of dome plate 72.

When top plate assembly 34 is installed into a can end 10, after cover plate 42 is pivoted to its installed position (shown in FIG. 3A), skirt 64 of cover plate 42 preferably contacts the upper surface of center panel 16 to support cover plate 42. The configuration of the cover plate 42 and its thickness preferably are chosen to resist deflection, and therefore not transmit force or impact to base plate 32, but rather transmit the force or impact to center panel 16. Thus, cover plate 42 prevents or inhibits accidental opening of closure 30 if a downward force or impact is applied to cover plate 42. In this regard, cover plate 42 preferably is relatively rigid compared with anchor plate 40 such that the flexing of anchor plate 40 (shown in its flexed position in FIG. 3B) enables base plate 32 to deflect downwardly at its periphery relative to cover plate 42 during the opening process.

Figure 2C:
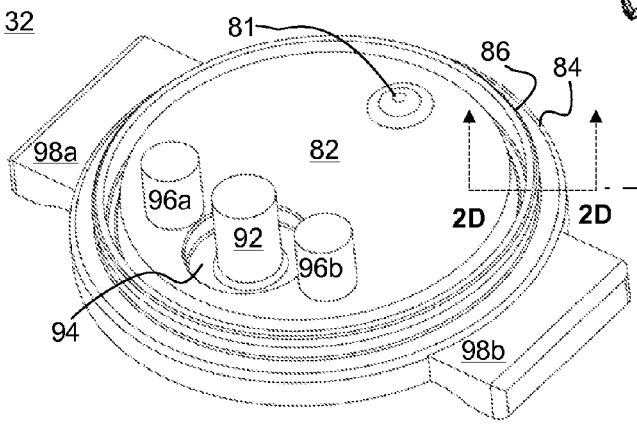
FIG. 2C is a perspective view of a base plate of the first embodiment in its pre-assembled state.
Figure 2D:
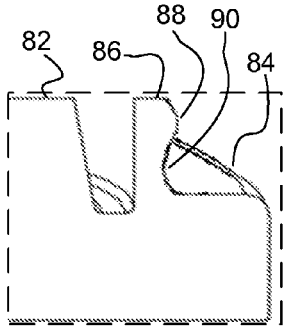
FIG. 2D is cross sectional view of the base plate depicted in FIG. 2C.

Referring now to FIGS. 2C and 2D, which show a first embodiment of base plate 32, base plate 32 includes a planar (or nearly planar) plate member 82, a continuous, circumferential flange 84 extending from a periphery of plate member 82, and a continuous ring 86 extending upwardly from flange 84. Ring 86 may extend circumferentially around base plate 32. Base plate 32, flange 84, and ring 86 preferably have approximately the same shape as aperture 20. Accordingly, in the embodiment shown, base plate 32, flange 84, and ring 86 are circular to match the shape of aperture 20.

Ring 86 includes a bead 88 extending around the outboard side thereof and a recess 90 formed below bead 88. A rivet 92, shown in FIG. 2C in its as-molded, pre-deformed state, extends upwardly from plate member 82. A circumferential recess 94 is formed in plate member 82 around rivet 92. A pair of anti-rotation posts 96*a* and 96*b* extend upwardly from plate member 82. A pair of wings 98*a* and 98*b* extend on opposite sides of flange 84. One or more pimples or rounded protrusions 81 extend upwardly from the surface of plate member 82.

When base plate 32 is installed into a can end 10, rivet 92 is inserted into rivet aperture 52 of top plate assembly 34. Rivet 92 is deformed to include a head 93 (shown in FIGS. 3A and 3C) that affixes base plate 32 to anchor plate 40. Deforming rivet 92 to create head 93 may be accomplished by any mechanism and equipment, as will be understood by people familiar with plastic packaging technology.

When base plate 32 is installed into a can end 10, rivet 92 extends through rivet aperture 52 and head 93 is deformed to engage seat 54*a*. Aperture ring 54*b* on the underside of anchor plate 40 is inserted into circumferential recess 94 in base plate 32, which provides an interlocking engagement between base plate 32 and anchor plate 40 of top plate assembly 34. Anti-rotation posts 96*a* and 96*b* of base plate 32 are inserted into corresponding post apertures 56*a* and 56*b* of anchor plate 40.

Referring now to FIGS. 3A-3D, which show closure 30 in its assembled state, the upper edge of double seam 18 preferably is above the highest part of closure 30. Accordingly, handling and seaming a can end 10 may be accomplished with conventional equipment and technology. The end, except for the aperture 20 and closure 30, may be conventional, such as a standard B-64 end or a SuperEnd™ supplied by Crown Cork & Seal Company, Inc. U.S. Pat. No. 6,065,634 describes aspects of the latter end. The present invention also encompasses ends having other configurations; for example and not intending to be limiting, an end having a deeper center panel, a deeper countersink, and/or increased metal thickness compared with a commercial end may be employed according the desired characteristics of the end structure, materials, and function, as will be understood by persons familiar with can end technology.

In its assembled state, base plate 32 is located on the underside of center panel 16 such that the flat surface of flange 84 is in contact with the underside of curl 22 to form face seal 38, and the outboard portion of ring 86 (preferably recess 90) contacts the radially innermost portion of curl 22 to form bore seal 36. In this regard, the outer diameter of flange 84 preferably is larger than the inner diameter of curl 22 to enable engagement therebetween (e.g., face seal 38) and to retain closure 30 onto center panel 16 even in conditions of high pressure within the can 1. For example, the beverage can 1 may encounter high temperature, rough handling, or dropping that may create a high continuous or transient pressure and result in a large continuous or transient force on closure 30. The location of circumferential flange 84 beneath center panel 16 prevents or decreases the likelihood of the sudden failure (sometimes referred to as "missiling") of the closure 30 upon a high internal pressure condition of this type.

Ring 86 is sized to be insertable into aperture 20 and is resilient or flexible such that the outer diameter of bead 88 is larger than the diameter of aperture 20. Accordingly, ring 86 preferably undergoes some deflection to move from its initial, as-molded state to its installed state. Further, the installed diameter of ring 86 preferably is smaller than its initial, as-molded diameter (that is, ring 86 preferably engages curl 22 in a snap fit) to enhance the effectiveness of bore seal 36.

At conventional low pressure conditions, bore seal 36 is the primary sealing mechanism. For example, for the embodiment shown in FIGS. 3A-3D, it is believed that bore seal 36 is more effective than face seal 38 below about internal pressures of about 20 psi. At about 20 psi to about 50 psi, bore seal 36 gradually loses effectiveness because of the elongation or growth of the pour opening as the center panel deflects upwardly into a dome shape. As bore seal 36 loses effectiveness, however, face seal 38 is urged against the underside of center panel 16 with increasing force by the internal can pressure, which enhances the effectiveness of face seal 38. The particular internal pressure level above which face seal 38 becomes more effective than the bore seal 36 may depend on the particular shape, size, and other characteristics of the closure 30. In some embodiments, for example, such as thirteenth embodiment closure 30*m* shown in FIGS. 10A-10D, face seal 38 may become effective at an internal pressure of 5 psi.

Accordingly, it is preferred that closure 30 has both a face seal 38 and a bore seal 36, which work together to seal aperture 20 even when encountering the doming deflection of center panel 16 at expected pressures. Upon venting, the release of internal pressure decreases or eliminates the doming deflection. After resealing, the center panel may again undergo doming due to increased internal pressure caused by the release of dissolved gases from liquid into the headspace, and the bore seal 36 and face seal 38 cooperation is again beneficial.

FIG. 3A (and FIG. 1A) illustrates first embodiment closure 30 in its installed state before actuation, which is also the fully closed or sealed position. To operate closure 30, a user places his finger under tab 77 and lifts up tab plate 44. This lifting action causes tab plate 44 to rotate about weakening or groove 80. Accordingly, the weakening or groove 80 forms and functions as a living hinge. Tab plate 44 preferably is pivoted about the living hinge until it is vertical, thereby enabling tab plate 44 to act as a handle or grip.

The first actuation of the living hinge preferably creates stress whitening at or around weakening or groove 80. The thermoplastic material of top plate assembly 34 may be chosen to ensure that stress whitening is visible and may be chosen to enhance the stress whitening effect. Preferably top plate assembly 34 has a color other than white to enhance the visibility of the stress whitening. Accordingly, the stress whitening of the living hinge provides evidence that closure 30 is not in its as-installed state and had been previously opened. Also, tab plate 44 preferably does not fully reseat to its original, initial position after the first time it is pivoted upward, and in this way provides tamper evidence.

Figure 3B:
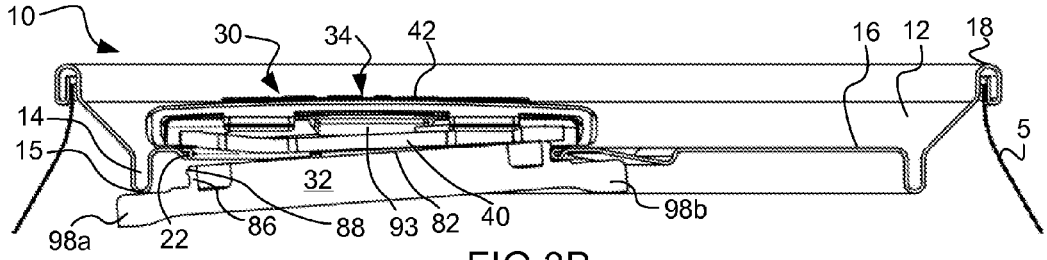
FIG. 3B is a cross sectional view of the first embodiment in an intermediate position.

FIG. 3B (and FIG. 1B) illustrates first embodiment closure 30 in the vented position, which is an intermediate position between the fully closed and fully open positions. The arrows on the topside of cover plate 42 indicate that upright tab plate 44 may be rotated or twisted in either direction, like the action of turning a dial. Posts 96*a* and 96*b* transmit torque between top plate 34 and base plate 32. The rotation of tab plate 44 causes the entire closure 30 to rotate, which moves one of wings 98*a* and 98*b* against the underside 15 of end countersink 14.

As wing 98*a* or 98*b* is forced beneath countersink underside 15 by the rotation of closure 30, base plate 32 flexes or tilts relative to center panel 16 to break bore seal 36 and face seal 38. In this regard, a portion of base plate 32 is displaced relative to center panel 16 such that a portion of ring 86 becomes disengaged from curl 22 as bead 88 is pulled below curl 22 over a portion of the circumference of curl 22. Breaking the seal in this way enables venting of the pressure in the headspace beneath can end 10.

Figure 3C:
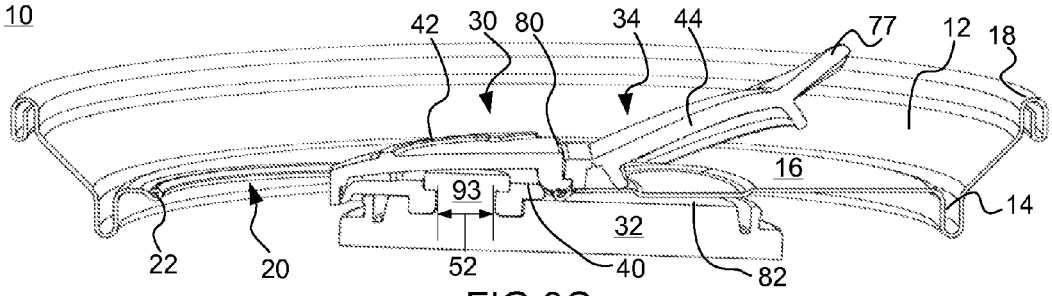
FIG. 3C is a cross sectional view of the first embodiment in the fully open position.

FIG. 3C (and FIG. 1C) illustrates first embodiment closure 30 in the fully open and operational position. From the vented position, the user continues to grip tab plate 44 and pulls or slides closure 30 to expose aperture 20 to enable drinking or pouring liquid through aperture 20. Thus, closure 30 may be actuated by gripping tab plate 44, twisting it, and pulling it, without the user letting go of tab plate 44.

To the extent necessary, the attachment of top plate 34 to base plate 32 by rivet 92 has the inherent capability of flexing to enable base plate 32 to ride underneath center panel 16 and to enable tab plate 44 to ride overtop of center panel 16. Posts 96*a* and 96*b* are longitudinally slideable in corresponding post apertures 56*a* and 56*b* to enhance the ability of base plate 32 to flex or deform relative to top plate 34 while transmitting torque from top plate assembly 34 to base plate 32.

In the fully open position, protrusions 81 (shown in FIG. 2C) are located and sized to contact the underside of center panel 16 or, preferably, to curl 22. Protrusions 81 act as spacers to increase the angle at which base plate 32 is oriented relative to center panel 16, and therefore increase the area at which the air can rush into can headspace during beverage pouring. This increased vent area for inrushing air diminishes the glugging effect and increases the flow rate during pouring.

To reseal closure 30, the user first grips tab plate 44 and pulls or slides closure 30 to cover aperture 20, and the user then pulls up on tab plate 44 to cause ring 86 to be inserted into aperture 20. The user pulls up on tab plate 44 hard enough so that bead 88 is forced above curl 22, such that ring 86 engages curl 22 in a snap fit. The resealed position of closure 30 is the same as the fully closed position of closure 30 shown in FIG. 3A (and FIG. 1A).

To describe further embodiments, reference numerals with an appended letter correspond to like structure of the first embodiment described above; reference numerals with appended letters correspond to structure of each embodiment. For example, FIGS. 4A through 4D illustrate, second, third, fourth, and fifth embodiments of a resealable can end, each of which has a base plate (32*a*, 32*b*, 32*c*, and 32*d*, respectively) that actuates in a similar manner as the base plate as described with closure 30 shown in FIGS. 3A-3D. Base plate 32*a*, 32*b*, 32*c*, and 32*d* may be used in place of base plate 32 shown in FIGS. 2C and 2D.

Second embodiment base plate 32*a* includes a circumferential bore groove 87 between bore seal 36 and face seal 38, preferably formed vertically about outer circumference of ring 86*a*. Bore groove 87 lengthens recess 90, which increases the vertical distance that ring 86*a* protrudes from flange 84*a*, thereby allowing ring 86*a* to deflect more easily (compared with like structure not having a circumferential groove about the ring) when curl 22 presses against ring 86*a*. The inventors believe that the increased flexibility of ring 86*a* when curl 22 presses against ring 86*a* may reduce the force required for a user to reseal closure 30. When the user pulls up on tab plate 44 (shown in FIGS. 3A and 3C) so that ring 86*a* engages curl 22 in a snap fit, the pulling force required to force bead 88 above curl 22 may be reduced due to the increased vertical length and the resulting increased flexibility of ring 86*a*. Bore groove 87 may have any depth relative to the upper surface of flange 84*a*. The inventors believe that bore groove 87 may reduce the stress experienced by ring 86*a* from curl 22 pressing against ring 86*a* at bore seal 36 when closure 30 is in the fully closed position. Reducing the stress experienced by ring 86*a* at bore seal 36 may reduce the creep experienced by ring 86*a* that may cause local deformation of ring 86*a* at bore seal 36. Reducing the creep experienced by ring 86*a* at bore seal 36 may improve the ability of bore seal 36 to maintain a seal and to withstand leaks (e.g., beverage or gas leaks) after closure 30 is actuated and resealed. If it is desired to maintain the pulling force required to force bead 88 above curl 22 above a predetermined magnitude while reducing the localized stress (during pressurization) experienced by ring 86*a* from curl 22 pressing against ring 86*a* at bore seal 36 when closure 30 is in the fully closed position, bore groove 87 may be used with a thicker ring 86*a* (compared with ring thickness of a configuration having no bore groove).

Figure 4A:
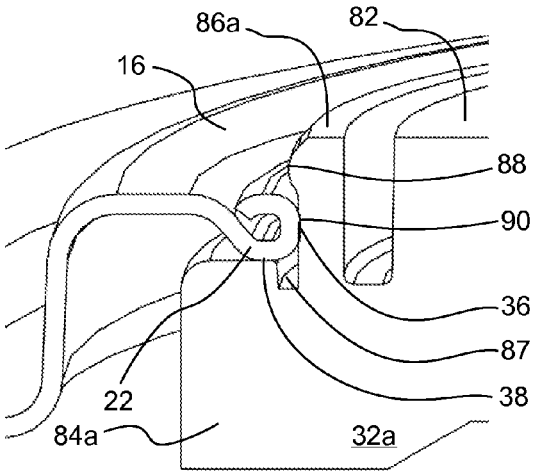
FIG. 4A is a cross sectional view of a second embodiment base plate closure seal arrangement suitable for use with the top plate shown in FIG. 2A having an extra groove in the base plate.
Figure 4B:
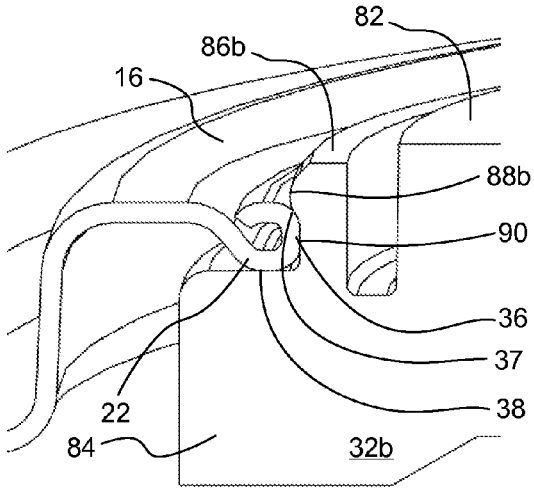
FIG. 4B is a cross sectional view of a third embodiment base plate closure seal arrangement suitable for use with the top plate shown in FIG. 2A having a shortened seal rim.

FIG. 4B illustrates a third embodiment of the resealable can end. Base plate 32*b* includes a bead 88*b* protruding from ring 86*b* that is spaced apart from flange 84 by a distance that enables curl 22 to engage at three locations, as explained more fully below. Merely for the purpose of comparing the position of third embodiment bead 88*b* and first embodiment bead 88, the recess 90 of the third embodiment hay be considered to have a diminished height compared with the recess of the first embodiment. The spacing of bead 88*b* and the size of curl 22 chosen to fit within recess 90 enables the positioning or registration of curl 22 relative to ring 86*b*.

When third embodiment closure 30 is in the fully closed position, curl 22 contacts base plate 32*b* in three positions:

flange 84 (face seal 38), recess 90 (bore seal 36), and the underside of bead 88*b* (bead seal 37). Preferably, lower bead 88*b* is located on ring 86*b* to provide zero or very little clearance between curl 22 and the underside of bead 88*b* when closure 30 is in the fully closed position.

The contact or small clearance between curl 22 and the underside of bead 88*b* may provide a reactive force of bead 88*b* against curl 22 at bead seal 37 that includes a downward directed component during the closing process and/or in its closed position, pushing curl 22 downward into flange 84, thereby helping to energize the face seal 38 at a lower pressure inside beverage can 1 than, for example, in the first embodiment shown in FIGS. 3A-3D.

Further, the zero or very little clearance between curl 22 and the underside of bead 88*b* may allow the position of curl 22 to be more constantly or accurately maintained when closure 30 is in the fully closed position. It is believed that more constant or accurate maintenance of the position of curl 22 at a specific location along ring 86*b* may allow the position of curl 22 to be approximately constant, regardless of whether bore seal 36 is the primary seal (such as at lower internal pressure) or whether face seal 38 is the primary seal (such as at higher internal pressure).

Sometimes, the stress experienced by ring 86*b* at bore seal 36 during pressurization of the beverage can 1 may cause the material at the face of ring 86*b* to creep, which may cause local deformation (or formation of a groove) in recess 90 at bore seal 36. The inventors believed that improved repeatability in locating the resting position of curl 22 in recess 90 (that is, reducing the range of potential positions of curl 22 along ring 86*b*) will enhance the tendency of curl 22 to return to approximately the same position along recess 90 when closure 30 is resealed. If a groove has been formed in recess 90 during pressurization, forcing curl 22 to return to approximately the same position (e.g., the groove formed in recess 90) after closure 30 is actuated and resealed may improve the ability of bore seal 36 to maintain a seal and to withstand leaks (e.g., beverage or gas leaks) after closure 30 is actuated and resealed.

Figure 4C:
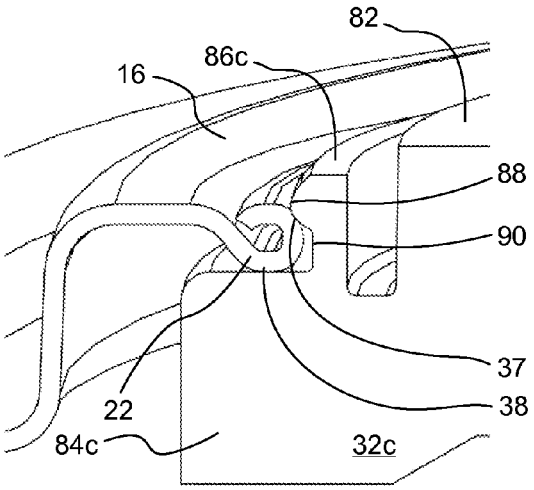
FIG. 4C is a cross sectional view of a fourth embodiment base plate closure seal arrangement suitable for use with the top plate shown in FIG. 2A having a retention bead seal.

FIG. 4C illustrates a fourth embodiment of the resealable can end. Base plate 32*c* includes a lower bead 88*c* protruding from ring 86*c* and a correspondingly shorter recess 90, compared with the higher location of bead 88 and longer recess 90 shown in FIGS. 2C and 2D, and compared with the higher location of bead 88*b* and longer recess 90 shown in FIG. 4B.

When fourth embodiment closure 30 is in the fully closed position, the very short recess 90 prevents curl 22 from contacting recess 90 on ring 86*c* when closure 30 is in the fully closed position. Instead, curl 22 contacts ring 86*c* at flange 84*c* (face seal 38) and on the underside of bead 88, forming a bead seal 37.

When fourth embodiment closure 30 is in the fully closed position, at low pressure conditions, the inventers believe that the bead seal 37 is the primary sealing mechanism. At higher pressure conditions, the face seal 38 achieves enhanced effectiveness. Compared to other embodiments, the inventors believe that the lower location of bead 88 on ring 86*c* may help energize (i.e., begin to achieve seal effectiveness) face seal 38 at a relatively low internal can pressure.

It is believed that fourth embodiment closure 30 enhances the ability of base plate 32*c* to be used on a wide range of can ends. For example, for a particular design of base plate 32*c*, base plate 32*c* may be able to be used to seal can ends having a range of curl 22 diameters. This ability of fourth embodiment closure 30 to be used to seal can ends having a range of curl 22 diameters may allow a manufacturer to use a single design of base plate 32*c* on multiple beverage can products.

Figure 4D:
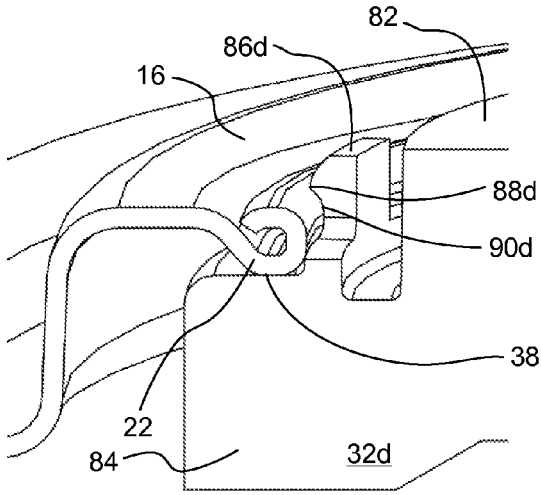
FIG. 4D is a cross sectional view of a fifth embodiment base plate closure seal arrangement suitable for use with the top plate shown in FIG. 2A having a clip energized face seal.
Figure 5A:
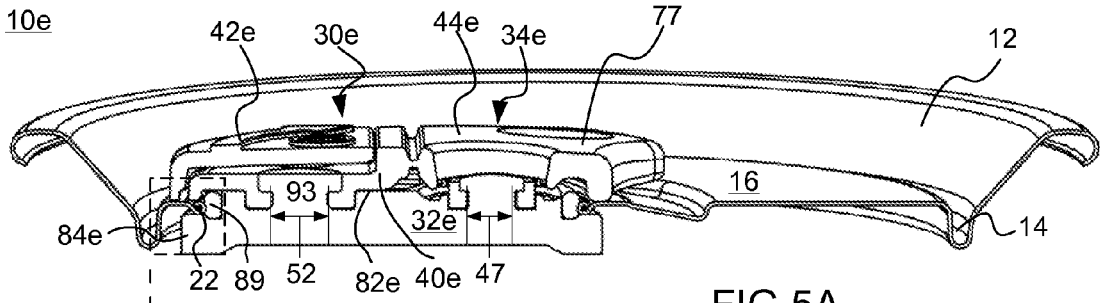
FIG. 5A is a cross sectional view of a sixth embodiment closure assembled onto a can end in the fully closed position having an elastomeric ring.
Figure 5B:
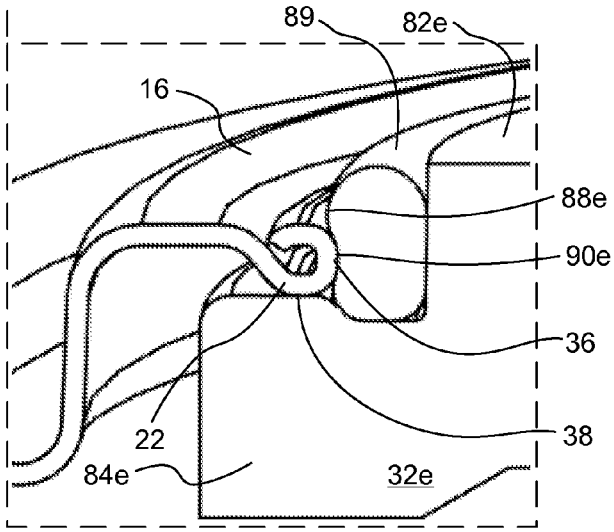
FIG. 5B is an enlarged view of a portion of FIG. 5A depicting a sealing portion of the end.
Figure 5C:
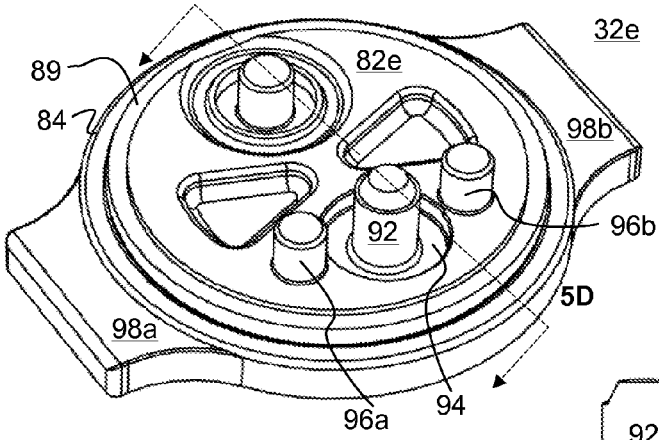
FIG. 5C is a perspective view of a bottom plate configuration that may be employed with the sixth embodiment closure having an alternative structure for tamper evidence.
Figure 5D:
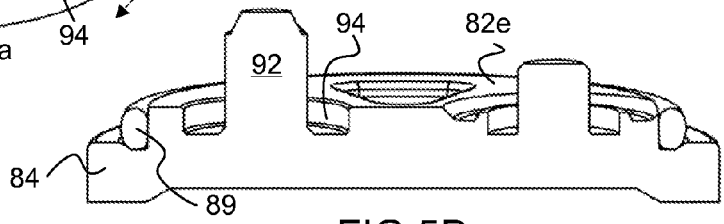
FIG. 5D is cross sectional view of the bottom plate depicted in FIG. 5C.

FIG. 4D illustrates a fifth embodiment of the resealable can end. Base plate 32*d* includes one or more ring portions, each of which includes one or more upwardly projecting clips 86*d*. Each clip 86*d* preferably includes a recess 90*d* that is curved to approximately match the shape of curl 22. Clips 86*d* may be located circumferentially around base plate 32*d* to receive curl 22 and preferably extend circumferentially over only a few degrees or arc.

When fifth embodiment closure 30 is in the fully closed position, face seal 38 will be the primary sealing mechanism at any pressure condition. In the fully closed position, curl 22 contacts base plate 32*d* at flange 84 (face seal 38), recess 90*d*, and the underside of bead 88*d* (that is, the upper limitation of recess 90*d*). the inventors believe that the approximate matching of the shape of recess 90*d* with the shape of curl 22 may pull flange 84 into contact with the underside of curl 22, thereby energizing face seal 38, even without any internal can pressure.

Base plate 32*d* may include any number of clips 86*d*. Although as shown in FIG. 4D, base plate 32*d* includes a plurality of clips 86*d*, base plate 32*d* may include a single clip 86*d*. In such embodiments including a single clip 86*d*, the contact area between curl 22 and recess 90*d* may create a bore seal 36.

FIGS. 5A-5D illustrate a sixth embodiment of the resealable can end. Base plate 32*e*, which is included in closure 30*e*, actuates in a similar manner as base plate 32 that is included in closure 30 shown in FIGS. 3A-3D.

Base plate 32*e* includes an elastomeric ring 89. As shown in FIGS. 5A-5D, elastomeric ring 89 is a ring of deformable material, such as an elastic material, such as silicone, a thermoplastic elastomer (TPE), or any other material that may be softer than the commercially available thermoplastic material used for base plate 32*e*. Because elastomeric ring 89 is deformable, the inventors surmise that ring 89 can diminish the negative effects of creep of base plate 32*e* at bore seal 36 under high temperature and/or high pressure environments of can 1. It is believed that reducing the amount of creep experienced at bore seal 36 may improve the ability of bore seal 36 to maintain a seal and to withstand leaks (e.g., beverage or gas leaks) after closure 30*e* is actuated and resealed. Also, in the sixth embodiment closure 30*e*, the inventors surmise that because bore seal 36 may have an improved ability to reseal, face seal 38 may be omitted, such that bore seal 36 may provide the only seal between curl 22 and base plate 32*e*.

Elastomeric ring 89 is shown as having a substantially oval cross sectional shape, elastomeric ring 89, and may have other cross sectional shapes. For example, elastomeric ring 89 may have a circular, square, rectangular, hexagonal, or an irregular rounded cross section. Elastomeric ring 89 may have a symmetric cross sectional shape, or elastomeric ring 89 may have an asymmetric cross sectional shape, for example, wherein the portion of elastomeric ring 89 that contacts curl 22 includes a bead 88*e* and a recess 90*e*, but the portion of elastomeric ring 89 opposite recess 90*e* is flat.

Elastomeric ring 89 may be assembled into base plate 32*e*, for example, by providing an interference fit between elastomeric ring 89 and base member 82*e*, or by gluing elastomeric ring 89 to base member 82*e* or flange 84*e*. Elastomeric ring 89 may be sequentially molded into base plate 32*e*, such that that material comprising elastomeric ring 89 is softer than the material comprising other portions of base plate 32*e*. Elastomeric ring 89 may be coated onto base plate 32*e* or compound lined into a groove in base plate 32*e*.

When sixth embodiment closure 30*e* is in the fully closed position, the soft material of elastomeric ring 89 wraps around the outer diameter of curl 22 to create bore seal 36.

The contact (e.g., bore seal 36) between recess 90*e* and curl 22 has enhanced and greater contact area due to the softer material of elastomeric ring 89. The inventors believe that softer material of elastomeric ring 89 may help energize bore seal 36 at a relatively low internal can pressure.

It is believed that the softer material of elastomeric ring 89 compared to the thermoplastic material of other portions of base plate 32*e* may increase the friction force between elastomeric ring 89 and curl 22 during actuation of the sixth embodiment closure (e.g., during the venting portion of actuation wherein base plate 32*e* is rotated relative to curl 22). Optionally, to compensate for the increased friction force between elastomeric ring 89 and curl 22, base plate 32*e* may be designed such that the initial attachment mechanism (e.g., adhesive) between base plate 32*e* and elastomeric ring 89 is broken during the venting portion of the actuation process, thereby allowing elastomeric ring 89 to maintain an approximately fixed rotational orientation relative to curl 22, while the remainder of base plate 32*e* may rotate relative to elastomeric ring 89. Such embodiments may reduce the force required for a user to rotate base plate 32*e* relative to curl 22 (e.g., to accomplish the venting portion of actuation), because the friction force between base plate 32*e* and curl 22 during the rotation of base plate 32*e* may be lower than the friction force between base plate 32*e* and elastomeric ring 89.

Figure 6A:
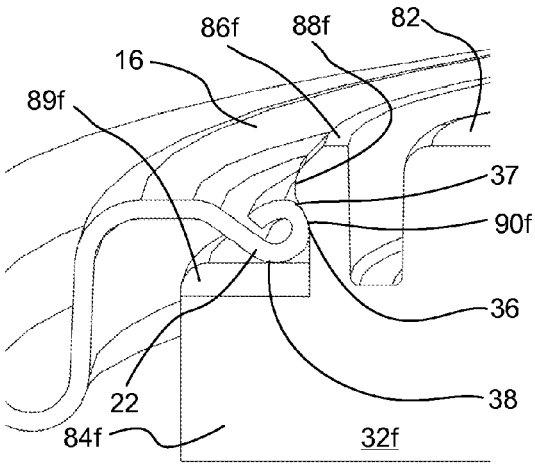
FIG. 6A is a cross sectional view of a seventh embodiment base plate closure seal arrangement suitable for use with the top plate shown in FIG. 2A having an elastomeric face seal.

FIG. 6A illustrates a seventh embodiment of the resealable can end. Base plate 32*f* actuates in a similar manner as base plate 32 that is included in closure 30 shown in FIGS. 3A-3D. Base plate 32*f* may be used in place of base plate 32 shown in FIGS. 2C and 2D. Base plate 32*f* includes an elastomeric surface 89*f* as the upper surface of the flange 84 shown in FIGS. 2C and 2D. As shown in FIG. 6A, elastomeric surface 89*f* is a ring-shaped surface of soft elastic material such as silicone, a thermoplastic elastomer (TPE), or any other material that may be softer than the commercially available thermoplastic material used for base plate 32*f*.

Elastomeric surface 89*f* is shown as having a substantially rectangular cross sectional shape, and elastomeric surface 89*f* may have other cross sectional shapes. For example, elastomeric surface 89*f* may have a circular, oval, square, hexagonal, or an irregular rounded or flat cross section.

Elastomeric surface 89*f* may be assembled into base plate 32*f*, for example, by providing an interference fit between elastomeric surface 89*f* and ring 86*f*, or by gluing elastomeric surface 89*f* to flange 84*f* or ring 86*f*. Elastomeric surface 89*f* may be sequentially molded into base plate 32*f*, such that the material comprising elastomeric surface 89*f* is softer than the material comprising other portions of base plate 32*f*. Elastomeric surface 89*f* may be coated onto base plate 32*f* or compound lined into a groove in base plate 32*f*.

When seventh embodiment closure 30 is in the fully closed position, the soft material of elastomeric surface 89*f* partially deforms around the outer diameter of curl 22 to create face seal 38. The contact (e.g., face seal 38) between flange 84*f* (at elastomeric surface 89*f*) and curl 22 may have a larger contact area due to the softer material of elastomeric surface 89*f*.

The inventors believe that the softer material of elastomeric surface 89*f* may help energize face seal 38 at a relatively low internal can pressure. Also, it is believed that because face seal 38 may be energized at a low internal can pressure, bore seal 36 may be omitted, such that face seal 38 may provide the only seal between curl 22 and base plate 32*f*. In embodiments where bore seal 36 is omitted, the sealing load may be provided by gas released by the product inside can 1.

Preferably elastomeric surface 89*f* is elastic, and which may diminish problems related to creep of base plate 32*f* at face seal 38 under high temperature and/or high pressure environments of can 1. It is believed that reducing the creep experienced at face seal 38 may improve the ability of face seal 38 to maintain a seal and to withstand leaks (e.g., beverage or gas leaks) after the seventh embodiment closure is actuated and resealed.

The inventors also believe that the softer material of elastomeric surface 89*f* compared to the thermoplastic material of other portions of base plate 32*f* may increase the friction force between elastomeric surface 89*f* and curl 22 during actuation of the seventh embodiment closure (e.g., during the venting portion of actuation wherein base plate 32*f* is rotated relative to curl 22). Optionally, to compensate for the increased friction force between elastomeric surface 89*f* and curl 22, base plate 32*f* may be designed such that the initial attachment mechanism (e.g., adhesive) between base plate 32*f* and elastomeric surface 89*f* is broken during the venting stage of the actuation process, thereby allowing elastomeric surface 89*f* to maintain an approximately fixed rotational orientation relative to curl 22, while the remainder of base plate 32*f* may rotate relative to elastomeric surface 89*f*. Such structure may reduce the force required for a user to rotate base plate 32*f* relative to curl 22 (e.g., to accomplish the venting portion of actuation), because the friction force between base plate 32*f* and curl 22 during the rotation of base plate 32*f* may be lower that the friction force between base plate 32*f* and elastomeric surface 89*f*.

When seventh embodiment closure 30 is in the fully closed position, curl 22 contacts base plate 32*f* in three positions: elastomeric surface 89*f* (face seal 38), recess 90*f* (bore seal 36), and the underside of bead 88*f* (bead seal 37). It is believed that the lower bead 88*f* location on ring 86*f* will result in zero or very little clearance between curl 22 and the underside of bead 88*f* when closure 30 is in the fully closed position.

The seventh embodiment base plate 32*f* is shown with three contact positions between curl 22 and base plate 32*f*, and elastomeric surface 89*f* may be used with other embodiments of closure 30 described herein that have different geometries of ring 86 and other portions of base plate 32. For example, elastomeric surface 89*f* may be used at the top of flange 84*a* in the second embodiment base plate 32*a* shown in FIG. 4A, wherein there is no contact between curl 22 and bead 88 when the closure is in the fully closed position. Also, elastomeric surface 89*f* may be used at the top of flange 84 in the fifth embodiment base plate 32*d* shown in FIG. 4D, wherein the ring 86 is replaced by clips 86*d*. Elastomeric surface 89*f* may also be used with any other closure embodiments described herein.

Figure 6B:
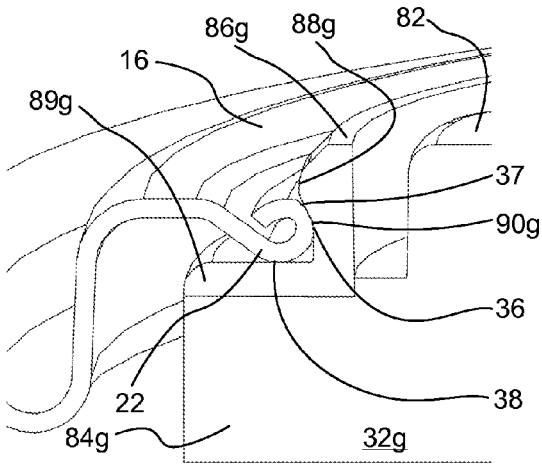
FIG. 6B is a cross sectional view of a eighth embodiment base plate closure seal arrangement suitable for use with the top plate shown in FIG. 2A having an elastomeric bore seal and face seal.

FIG. 6B illustrates an eighth embodiment of the resealable can end. Base plate 32*g* actuates in a similar manner as base plate 32 that is included in closure 30 shown in FIGS. 3A-3D. Base plate 32*g* may be used in place of base plate 32 shown in FIGS. 2C and 2D. Base plate 32*g* includes an elastomeric surface 89*g* as the upper surface of the flange 84 and the outer-facing surface of ring 86 shown in FIGS. 2C and 2D. As shown in FIG. 6B, elastomeric surface 89*g* is a ring-shaped surface of soft elastic material such as silicone, a thermoplastic elastomer (TPE), or any other material that may be softer than the commercially available thermoplastic material used for base plate 32*g*.

Although elastomeric surface 89*g* is shown as a singly formed L-shaped piece, elastomeric surface 89*g* may have other cross sectional shapes or may comprise two separate elastomeric surfaces: a first elastomeric surface at the bore seal 36 and a second elastomeric surface at the face seal 38. Also, elastomeric surface 89*g* may comprise two separate elastomeric elements shown in FIGS. 5A through 6A: a first elastomeric ring 89 at the bore seal 36 and a second elastomeric surface 89*f* at the face seal 38.

Elastomeric surface 89*g* may be assembled into base plate 32*g*, for example, by gluing elastomeric surface 89*g* to flange 84*g*. Elastomeric surface 89*g* may be sequentially molded into base plate 32*g*, such that that material comprising elastomeric surface 89*g* is softer than the material comprising other portions of base plate 32*g*. Elastomeric surface 89*g* may be coated onto base plate 32*g* or compound lined into a groove in base plate 32*g*. Alternatively, the entire base plate 32*g*, including elastomeric surface 89*g*, may be made from a soft elastic material such as silicone, a thermoplastic elastomer (TPE), or any other relatively soft commercially available thermoplastic material that is known in the art.

When eighth embodiment closure 30 is in the fully closed position, the soft material of elastomeric surface 89*g* partially deforms around the outer diameter of curl 22 to create bore seal 36, bead seal 37, and/or face seal 38. The contact at bore seal 36, bead seal 37, and/or face seal 38 between flange 84*g* and curl 22 and/or ring 86*g* and curl 22 provides enhanced or larger contact area due to the softer material of elastomeric surface 89*g*. It is believed that the softer material of elastomeric surface 89*g* may help energize face seal 38 at a relatively low internal can pressure.

Elastomeric surface 89*g* preferably is elastic, which may diminish problems related to creep of base plate 32*g* at bore seal 36, bead seal 37, and/or face seal 38 under high temperature and/or high pressure environments of can 1. It is believed that reducing the creep experienced at bore seal 36, bead seal 37, and/or face seal 38 may improve the ability of bore seal 36, bead seal 37, and/or face seal 38 to maintain a seal and to withstand leaks (e.g., beverage or gas leaks) after the eighth embodiment closure is actuated and resealed.

The softer material of elastomeric surface 89*g* compared to the thermoplastic material of other portions of base plate 32*g* may have increased friction force between elastomeric surface 89*g* and curl 22 during actuation of the eighth embodiment closure (e.g., during the venting portion of actuation wherein base plate 32*g* is rotated relative to curl 22). Optionally, to compensate for the increased friction force between elastomeric surface 89*g* and curl 22, base plate 32*g* may be designed such that the initial attachment mechanism (e.g., adhesive) between base plate 32*g* and elastomeric surface 89*g* is broken during the venting portion of the actuation process, thereby allowing elastomeric surface 89*g* to maintain an approximately fixed rotational orientation relative to curl 22, while the remainder of base plate 32*g* may rotate relative to elastomeric surface 89*g*. Such embodiments may reduce the force required for a user to rotate base plate 32*g* relative to curl 22 (e.g., to accomplish the venting portion of actuation), because the friction force between base plate 32*g* and curl 22 during the rotation of base plate 32*g* may be lower that the friction force between base plate 32*g* and elastomeric surface 89*g*.

When eighth embodiment closure 30 is in the fully closed position, curl 22 may contact base plate 32*g* in three positions: elastomeric surface 89*g* (face seal 38), recess 90*g* (bore seal 36), and the underside of bead 88*g* (bead seal 37). It is believed that the lower bead 88*g* location on ring 86*g* will result in zero or very little clearance between curl 22 and the underside of bead 88*g* when closure 30 is in the fully closed position.

The eighth embodiment base plate 32*g* is shown with three contact positions between curl 22 and base plate 32*g*, and elastomeric surface 89*g* may be used with other embodiments of closure 30 described herein that have different geometries of ring 86 and other portions of base plate 32. For example, elastomeric surface 89*g* may be used at the top of flange 84*a* in the second embodiment base plate 32*a* shown in FIG. 4A, wherein there is no contact between curl 22 and bead 88 when the closure is in the fully closed position. Also, elastomeric surface 89*g* may be used at the top of flange 84 in the fifth embodiment base plate 32*d* shown in FIG. 4D, wherein the ring 86 is replaced by clips 86*d*. Elastomeric surface 89*g* may also be used with any other closure embodiments described herein.

Figure 6C:
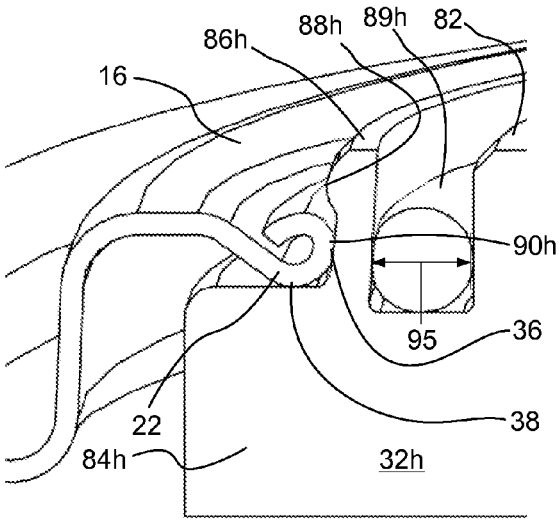
FIG. 6C is a cross sectional view of a ninth embodiment base plate closure seal arrangement suitable for use with the top plate shown in FIG. 2A having a ring energized bore seal.
Figure 6D:
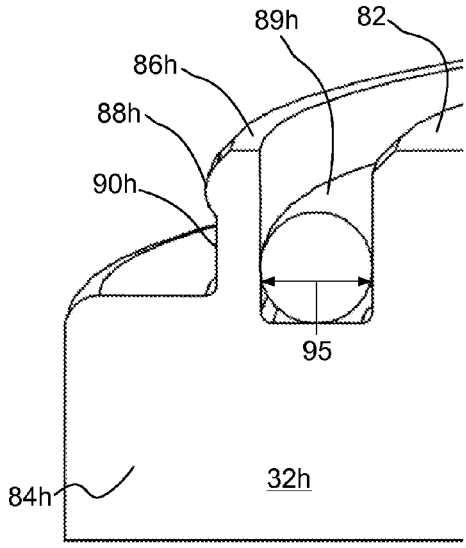
FIG. 6D is cross sectional view of the bottom plate depicted in FIG. 6C.

FIGS. 6C and 6D illustrate a ninth embodiment of the resealable can end in which base plate 32*h* actuates in a similar manner as base plate 32 that is included in closure 30 shown in FIGS. 3A-3D. Base plate 32*h* may be used in place of base plate 32 shown in FIGS. 2C and 2D. Base plate 32*h* includes a ring 89*h* (preferably elastic) in channel 95 behind (i.e., radially inward of) ring 86*h*. Ring 89*h* may be a ring of material such as a thermoplastic, rubber, silicone, a thermoplastic elastomer (TPE), a metal spring (e.g., an overlapping loop of metal wire), or any other material that may apply an outward radial force against ring 86*h*.

Ring 89*h* is shown as having a substantially circular cross sectional shape, and ring 89*h* may have other cross sectional shapes. For example, ring 89*h* may have an oval, square, rectangular, hexagonal, U-shaped, X-shaped, or an irregular rounded or flat cross section. ring 89*h* may be assembled into base plate 32*h*, for example, by gluing ring 89*h* into channel 95. ring 89*h* may be sequentially molded into channel 95, such that that material comprising ring 89*h* is softer than the material comprising other portions of base plate 32*h*. Ring 89*h* may be compound lined into a channel 95 in base plate 32*f*.

When ninth embodiment closure 30 is in the fully closed position, as shown in FIG. 6C, the soft material of ring 89*h* partially compresses in the radial direction due to the radially inward force applied by curl 22 against ring 86 to create bore seal 36. When ring 89*h* (which is preferably elastic) is compressed by a force applied by curl 22, ring 89*h* applies a radially outward reactive force against ring 86 and curl 22, such that ring 89*h* helps energize bore seal 36 when the ninth embodiment closure is reclosed. Ring 89*h* preferably is sized and positioned such that ring 89*h* applies a radially outward force approximately at the same vertical position along ring 86*h* as the contact point between curl 22 and ring 86*h* (i.e., bore seal 36).

Ring 89*h* provides an outward radial force against ring 86*h*, which may reduce problems related to creep of base plate 32*h* at bore seal 36 under high temperature and/or high pressure environments of can 1. It is believed that reducing the creep experienced at bore seal 36 may improve the ability of bore seal 36 to maintain a seal and to withstand leaks (e.g., beverage or gas leaks) after the ninth embodiment closure is actuated and resealed.

Ring 89*h* is shown in FIGS. 6C and 6D as touching the inner and outer side walls of channel 95, and ring 89*h* may be configured to touch only the outer side wall of channel 95 (i.e., the side wall of channel 95 that forms the inward-facing wall of ring 86*h*). In such embodiments wherein ring 89*h* touches only the outer side wall of channel 95, channel 95 may include horizontally extending protrusions or ridges to help maintain the vertical position of ring 89*h*, such that ring 89*h* applies a radially outward force approximately at the same vertical position along ring 86*h* as the contact point between curl 22 and ring 86*h* (i.e., bore seal 36).

The ninth embodiment base plate 32*h* is shown with two contact positions between curl 22 and base plate 32*h*, and ring 89*h* may be used with other embodiments of closure 30 described herein that have different geometries of ring 86 and other portions of base plate 32. For example, ring 89*h* may be used radially inward of ring 86*b* in the third embodiment base plate 32*b* shown in FIG. 4B, wherein there is additional contact between curl 22 and bead 88 (i.e., bead seal 37) when the closure is in the fully closed position.

Figure 7A:
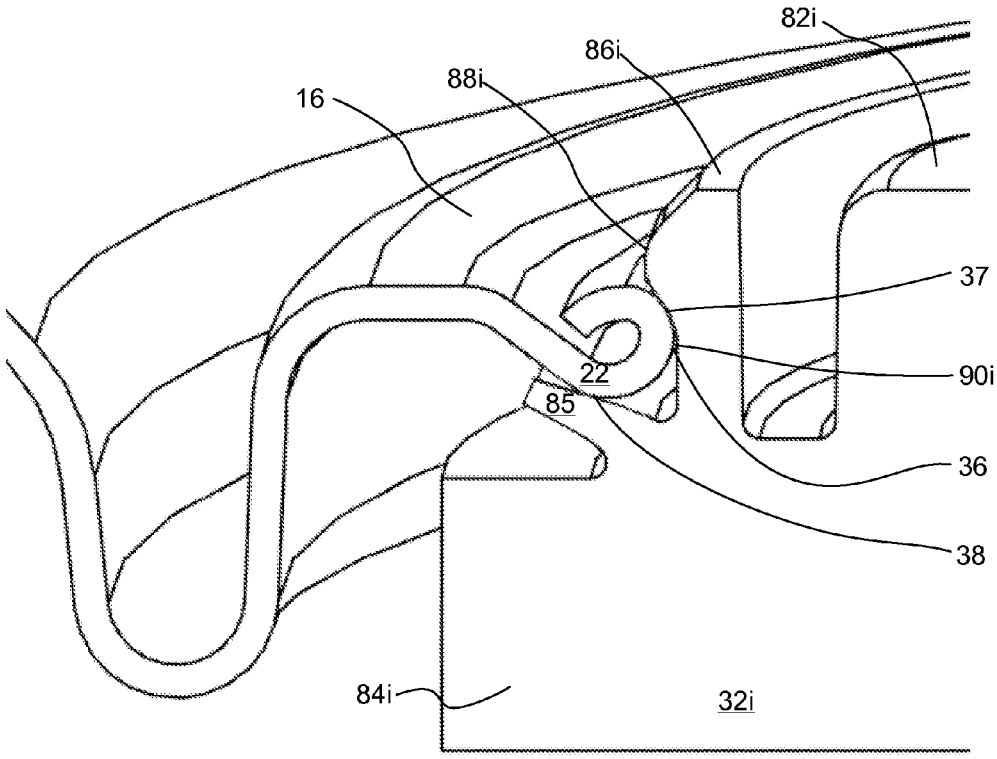
FIG. 7A is a cross sectional view of a tenth embodiment base plate closure seal arrangement suitable for use with the top plate shown in FIG. 2A having a wedge seal.
Figure 7B:
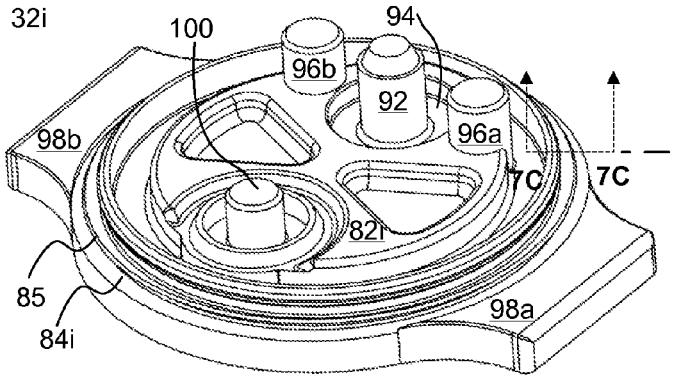
FIG. 7B is a perspective view of a bottom plate configuration that may be employed with the tenth embodiment closure having an alternative structure for tamper evidence.
Figure 7C:
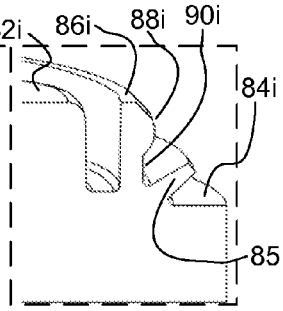
FIG. 7C is cross sectional view of the bottom plate depicted in FIG. 7B.

FIGS. 7A-7C illustrate a tenth embodiment of the resealable can end by which the face seal may be energized without any positive internal can pressure (relative to the outside of the can). Base plate 32*i* actuates in a similar manner as base plate 32 that is included in closure 30 shown in FIGS. 3A-3D. Base plate 32*i* may be used in place of base plate 32 shown in FIGS. 2C and 2D. Base plate 32*i* includes a fin 85 (which may be molded into the base plate 32*i*) protruding from the base of ring 86*i*. Fin 85 is positioned above flange 84*i*, such that face seal 38 is formed between curl 22 and fin 85. Fin 85 may extend circumferentially around base plate 32*i*.

Fin 85 preferably is flexible, such that when tenth embodiment closure 30 is placed in the fully closed position, curl 22 is wedged between fin 85 and the underside of bead 88*i*. The wedging of curl 22 against fin 85 compresses fin 85 downwards toward flange 84*i*, thereby producing a responsive force from fin 85 against curl 22 at face seal 38. The force from fin 85 pushes curl 22 against the underside of bead 88*i*, thereby creating either or both of a bore seal 36 between curl 22 and recess 90*i* and a bead seal 37 between curl 22 and the underside of bead 88*i*, even without any internal can pressure. The wedging of curl 22 between fin 85 and bead 88*i* may be achieved by designing an interference fit of curl 22 into the space defined by fin 85 and bead 88*i*, for example, wherein the clearance between fin 85 and the underside of bead 88*i* is 0.07 mm smaller than the width of curl 22 in a direction from the face seal 88 to the bead seal 37.

When tenth embodiment closure 30 is in the fully closed position, and a beverage included inside beverage can 1 releases entrapped gas to increase the pressure inside beverage can 1 relative to the outside of beverage can 1, for example, to 85 psi, the center of center panel 16 may be pushed upwards relative to the perimeter of center panel 16 and stretched into a dome shape, resulting in a "doming" effect of center panel 16. This doming effect of center panel 16 may slightly stretch aperture 20 and curl 22 that surrounds aperture 20 into an oval shape, for example, wherein the diameter of aperture 20 in a first direction may be 0.6 mm greater than the diameter of aperture 20 in a second direction that is substantially perpendicular to the first direction. When aperture 20 stretches into an oval shape while base plate 32*i* is installed into aperture 20, fin 85 may flex downward to a greater degree at some portions of contact with curl 22 and to a lesser degree at other portions of contact with curl 22, thereby maintaining the face seal 38 around the perimeter of the aperture 20.

FIGS. 8A-8E illustrate an eleventh embodiment of the resealable can end. Base plate 32*j* actuates in a similar manner as base plate 32 that is included in closure 30 shown in FIGS. 3A-3D. Base plate 32*j* may be used in place of base plate 32 shown in FIGS. 2C and 2D. Base plate 32*j* includes a ring 86*j* that is attached or anchored to the remainder of base plate 32*j* at the top of ring 86*j*, near plate member 82*j*.

Figure 8A:
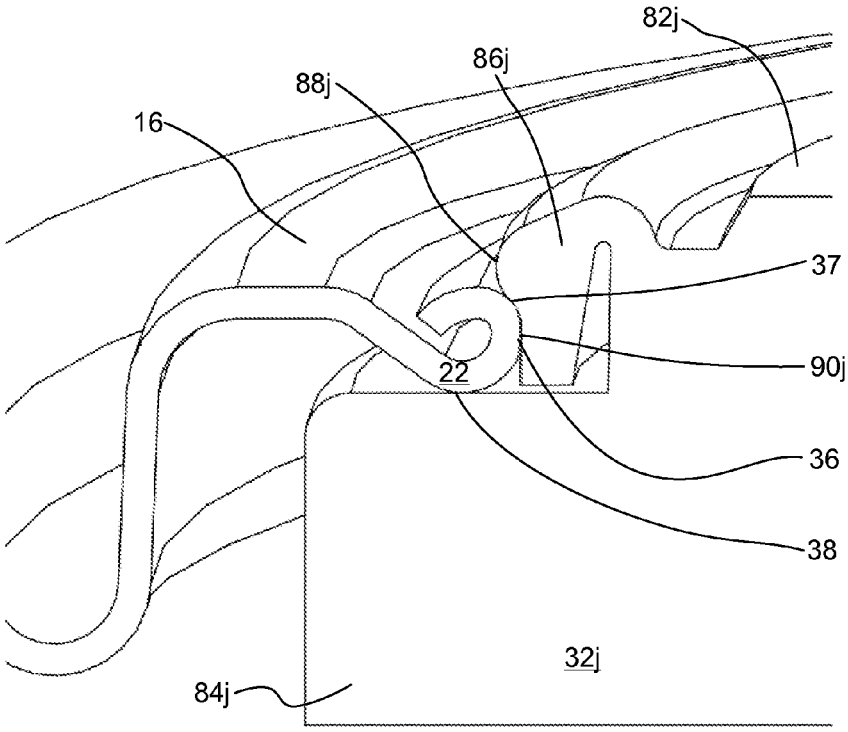
FIG. 8A is a cross sectional view of an eleventh embodiment base plate closure seal arrangement suitable for use with the top plate shown in FIG. 2A having an inverted seal.
Figure 8B:
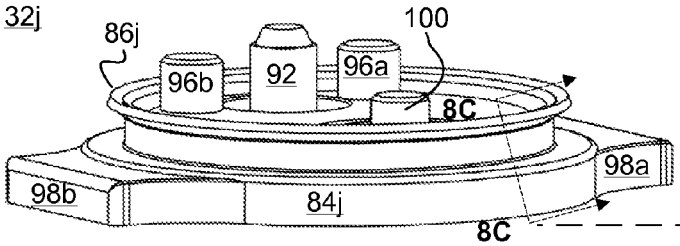
FIG. 8B is a perspective view of a bottom plate configuration that may be employed with the eleventh embodiment closure having an alternative structure for tamper evidence, shown in the as-molded position.
Figure 8C:
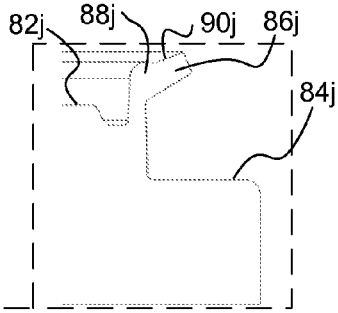
FIG. 8C is cross sectional view of the bottom plate depicted in FIG. 8B.
Figure 8D:
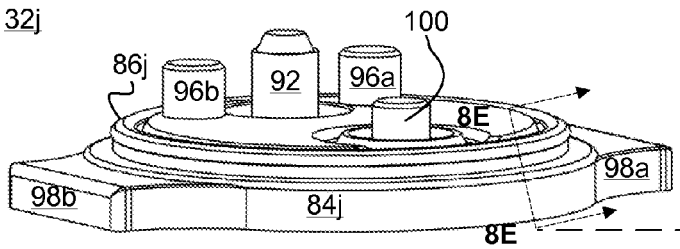
FIG. 8D is a perspective view of the bottom plate configuration depicted in FIG. 8B, shown in the seal folded position.
Figure 8E:
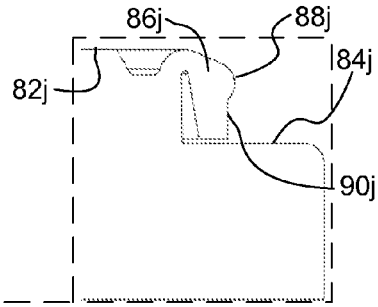
FIG. 8E is cross sectional view of the bottom plate depicted in FIG. 8D.

Ring 86*j* may be molded, for example, as shown in FIGS. 8B and 8C, wherein the end of ring 86*j* that is farthest away from the remainder of base plate 32*j* extends up and away from plate member 82*j*. Ring 86*j* may be inverted or prepared for assembly into aperture 20, for example, as shown in FIGS. 8C and 8D, wherein the end of ring 86*j* that is farthest away from the remainder of base plate 32*j* is bent downward towards flange 84*j* (i.e., ring 86*j* becomes inverted), and bead 88*j* is rotated to extend away from plate member 82*j*.

When eleventh embodiment closure 30 is in the fully closed position, curl 22 may contact base plate 32*j* in three positions: flange 84*j* (face seal 38), recess 90*j* (bore seal 36), and the underside of bead 88*j* (bead seal 37). Ring 86*j* may be able to flex in a radially inward direction (e.g., ring 86*j* may be flexible), pivoting about the anchor point at the top of ring 86*j*, such that when base plate 32*j* is installed into aperture 20, ring 86*j* may produce a responsive force in a radially outward direction against curl 22, when curl 22 is positioned against flange 84*j* and the underside of bead 88*i*.

The inward flexing of ring 86*j*, due to a radially inward compression force from curl 22, may be achieved by designing an interference fit between the diameter defined by curl 22 (i.e., the diameter of aperture 20) and the diameter defined by recess 90*j*. For example, the diameter of aperture 20 may be 0.15 mm smaller than the diameter defined by recess 90*j*, such that when the base plate 32*j* is installed into aperture 20, recess 90*j* is compressed inward by 0.15 mm (across the entire aperture 20), thereby producing a reactive force from recess 90*j* against curl 22 at bore seal 36.

When eleventh embodiment closure 30 is in the fully closed position, and a beverage included inside beverage can 1 releases entrapped gas to increase the pressure inside beverage can 1 relative to the outside of beverage can 1, for example, to 85 psi, the doming effect described above may stretch aperture 20 into an oval shape. When aperture 20 is stretched into an oval shape due to doming of center panel 16 while base plate 32*j* is installed into aperture 20, ring 86*j* may flex inward to a greater degree at some portions of contact with curl 22 and to a lesser degree at other portions of contact with curl 22, thereby maintaining the bore seal 36 around the perimeter of the aperture 20.

The stretching of aperture 20 into a larger oval aperture due to doming of center panel 16 may reduce the interference between the diameter defined by curl 22 and the diameter defined by recess 90*j*, for example, such that the interference is less than an initial 0.15 mm. This reduction of the interference may allow ring 86*j* to flex partially outward, towards the position taken by ring 86*j* when base plate 32*j* is not installed into aperture 20, thereby reducing the radial load that curl 22 exerts on ring 86*j* at bore seal 36. When the pressure inside beverage can 1 relative to the outside of beverage can 1 is reduced, for example, by opening and reclosing eleventh embodiment closure 30, the radial load that curl 22 exerts on ring 86*j* at bore seal 36 is increased, because the interference between the diameter defined by curl 22 and the diameter defined by recess 90*j* is increased, for example, such that the interference returns to the initial 0.15 mm.

The inventors believe that this inward flexing of ring 86*j* while base plate 32*j* is installed into aperture 20 (and the greater distance between bore seal 36 and the anchor point at the top of ring 86*j*) may reduce creep of the material comprising ring 86*j* at bore seal 36 under high temperature and/or high pressure environments of can 1, while eleventh embodiment closure 30 is in the fully closed position.

Base plate 32*j* includes a lower bead 88*j* protruding from ring 86*j* and recess 90*j* that preferably is sufficiently small to limit the potential range of positions that curl 22 can take along ring 86*j* when base plate 32*j* is installed into aperture 20. The inventors believe that the lower bead 88*j* location on ring 86*j* would result in zero or very little clearance between curl 22 and the underside of bead 88*j* when eleventh embodiment closure 30 is in the fully closed position. This clearance between curl 22 and the underside of bead 88*j* may provide a reactive force of bead 88*j* against curl 22 at bead seal 37 that includes a downward directed component, pushing curl 22 downward into flange 84*j*, thereby helping to energize the face seal 38 at a lower pressure inside beverage can 1 than, for example, in the first embodiment shown in FIGS. 3A-3D.

The inventors believe that the combination of the relatively lower location of bead 88*j* on ring 86*j* and the inward flexing of ring 86*j* when base plate 32*j* is installed into aperture 20 may allow the inward flexing of ring 86*j* to increase the load that curl 22 exerts on ring flange 84*j* at face seal 38. For example, when base plate 32*j* is installed into aperture 20, curl 22 pushes inward on ring 86*j* at recess 90*j*, and ring 86*j* rotates inward about the pivot point at the top of ring 86*j*. The inward pivoting of ring 86*j* pushes bead 88*j* slightly downward, which causes bead 88*j* to exert a downward force on curl 22 at bead seal 37, which pushes curl 22 downward into flange 84*j* at face seal 38.

Figure 9A:
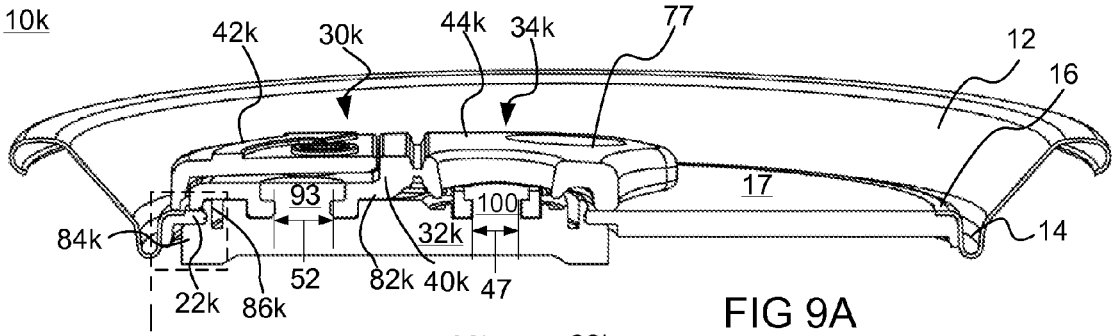
FIG. 9A is a cross sectional view of a twelfth embodiment closure assembled onto a can end in the fully closed position having a plastic panel.
Figure 9B:
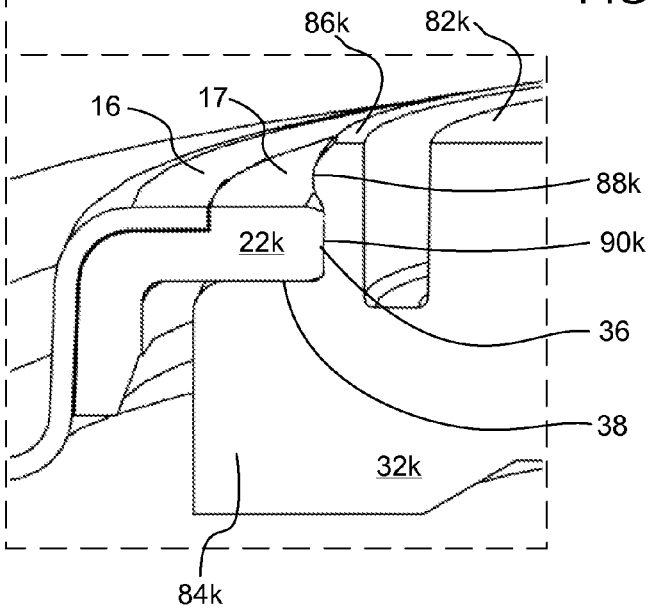
FIG. 9B is an enlarged view of a portion of FIG. 9A depicting a sealing portion of the end.
Figure 10A:
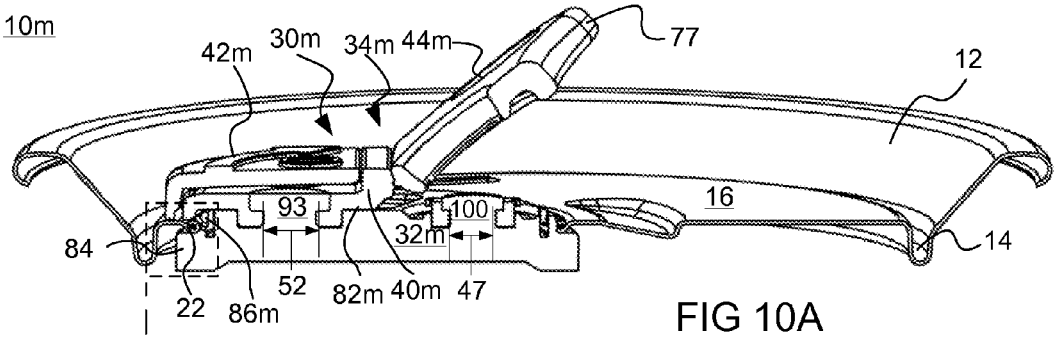
FIG. 10A is a cross sectional view of a thirteenth embodiment closure assembled onto a can end in the fully closed position having an externally energized face seal.
Figure 10B:
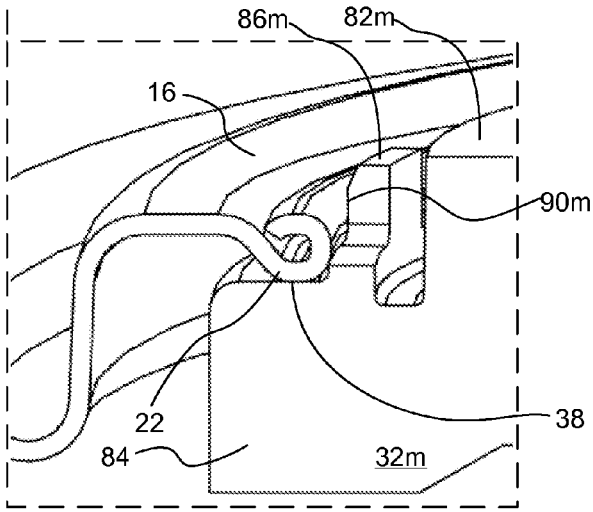
FIG. 10B is an enlarged view of a portion of FIG. 10A depicting a sealing portion of the end.
Figure 10C:
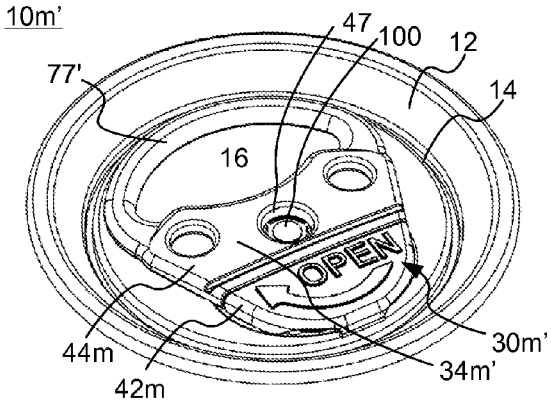
FIG. 10C is a perspective view of an alternative top plate configuration that may be employed with the eighth embodiment closure having a large pull tab.
Figure 10D:
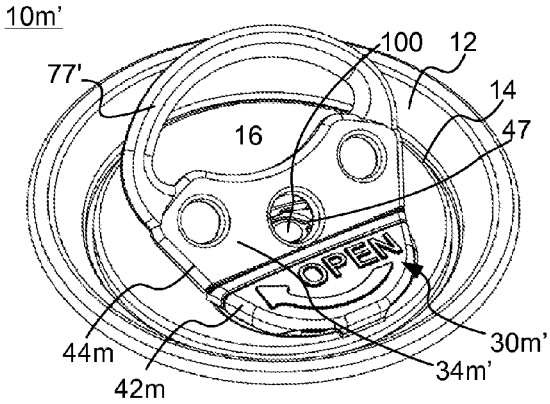
FIG. 10D is a perspective view of the top plate configuration depicted in FIG. 10C in the fully closed position with the pull tab raised.

FIGS. 9A-9B illustrate a twelfth embodiment of the resealable can end. Closure 30*k* actuates in a similar manner as closure 30 that is shown in FIGS. 3A-3D. Base plate 32*k* may be used in place of base plate 32 shown in FIGS. 2C and 2D.

In addition to the features shown and described with reference to FIGS. 3A-3D, closure 30*k* includes a plastic panel 17 that is coupled to the interior edges of a center retaining lip 16*k*. The combination of plastic panel 17 and center retaining lip 16*k* may perform a similar function as center panel 16 shown in FIGS. 3A-3D, including, for example, to help enclose a beverage inside of beverage can 1, to provide a surface through which aperture 20 extends, and to provide a surface to engage with closure 30*k*.

Plastic panel 17 may be formed, for example, from a commercially available thermoplastic that can be injection molded in a unitary piece, as understood by people familiar with packaging technology. Plastic panel 17 may be insert molded into can end 10*k*, or plastic panel 17 may be assembled into can end 10*k*, for example, by gluing plastic panel 17 onto center retaining lip 16*k* and/or a portion of countersink 14.

Aperture 20 in plastic panel 17 includes an edge 22*k* that serves a similar function as curl 22 shown in FIGS. 3A-3D, including, for example, mating with base plate 32*k* to form bore seal 36 and face seal 38. The radially inward-facing surface of edge 22*k*, which mates against recess 90*k*, may be rounded like curl 22, or edge 22*k* may be flat with chamfered or rounded edges.

Edge 22*k* preferably is plastic rather than metal. Plastic panel 17 may absorb some of the sealing force at bore seal 36 and face seal 38, and plastic panel 17 may compress when closure 30*k* is in the fully closed position, which may result in reduced creep of base plate 32*k* at recess 90*k* and flange 84*k* under high temperature and/or high pressure environments of can 1. Also, because the surfaces of edge 22*k* that mate with recess 90*k* and flange 84*k* to create bore seal 36 and face seal 38 may be flatter than the corresponding surfaces of curl 22 shown in FIGS. 3A-3D, the interface of edge 22*k* and recess 90*k* at bore seal 36 and the interface of edge 22*k* and flange 84*k* at face seal 38 may have wider spatially distributed sealing loads. The wider spatially distributed sealing loads may reduce the localized stress experienced by recess 90*k* and flange 84*k*, and may result in reduced creep of base plate 32*k* at bore seal 36 and face seal 38.

The inventors believe that reducing the creep experienced at bore seal 36 and face seal 38 may improve the ability of bore seal 36 and face seal 38 to maintain a seal and to withstand leaks (e.g., beverage or gas leaks) after closure 30*k* is actuated and resealed.

FIGS. 10A-10D illustrate a thirteenth embodiment of the resealable can end by which the reseal force exerted by a user may be very low, or in which no reseal force is necessary. Base plate 32*m* actuates in a similar manner as base plate 32 that is included in closure 30 shown in FIGS. 3A-3D. Base plate 32*m* and top plate assembly 34*m* may be used in place of base plate 32 and top plate assembly 34 shown in FIGS. 2C and 2D.

Base plate 32*m* includes one or more ring portions 86*m*, each ring portion 86*m* lacks an outwardly-protruding bead. When thirteenth embodiment closure 30*m* is in the fully closed position, face seal 38 will be the primary sealing mechanism at any pressure condition. In the fully closed position, curl 22 contacts base plate 32*m* at flange 84 (face seal 38) and bore contact surfaces 90*m*.

Base plate 32*m* may include any number of ring portions 86*m*. Base plate 32*m* includes a plurality of ring portions 86*m*; base plate 32*m* alternatively may include a single ring portion 86*m*. In such embodiments including a single ring portion 86*m*, the contact area between curl 22 and bore contact surface 90*m* may create a bore seal 36.

Closure 30*m* also may include a partially ring-shaped tab 77' that includes a through hole or internal void that is of a sufficient size to accommodate insertion of a user's finger. The ability of tab 77' to accommodate a user's finger may allow beverage can 1 to be carried by a user's finger that is looped around tab 77', for example, by looping a user's finger through a through hole included in tab 77'.

To energize face seal 38, a user (or a closing machine during filling) first grips tab 77' and pulls or slides closure 30*m* to cover aperture 20, and the user then pulls up on tab 77' to cause ring portions 86*m* to be inserted into aperture 20. If an interference fit is designed between the diameter defined by aperture 20 and the diameter defined by bore contact surfaces 90*m*, then the user pulls up on tab 77' hard enough so that ring portions 86*m* engage curl 22 in an interference fit.

Alternatively, to energize face seal 38, if there is not an interference designed between the diameter defined by aperture 20 and the diameter defined by bore contact surfaces 90*m*, then the user (or a closing machine during filling) first grips tab 77' and pulls or slides closure 30*m* to cover aperture 20, and the user then pulls up on tab 77' to cause ring portions 86*m* to be inserted into aperture 20, thereby providing an initial contact between curl 22 and flange 84 while face seal 38 is de-energized (e.g., there is no gas pressure pushing flange 84 against curl 22). Without an interference fit between aperture 20 and base plate 32*m*, internal can pressure may be used to energize face seal 38.

For example, when a user pulls tab 77' to place closure 30*m* into the fully closed position, a beverage included inside beverage can 1 may be agitated enough to release enough entrapped gas to increase the pressure inside beverage can 1 so that it is greater then the pressure outside of beverage can 1. If the internal can pressure is sufficient (e.g., 5 psi greater than the pressure outside beverage can 1), then the internal can pressure pushes flange 84 against curl 22 to create face seal 38.

Alternatively, if the agitation of the beverage inside beverage can 1 that is caused by a user pulling closure 30*m* to cover aperture 20 is insufficient to energize face seal 38, then a user may intentionally agitate the beverage inside beverage can 1 (e.g., by gently shaking the can) to release enough entrapped gas to sufficiently increase the pressure inside beverage can 1 (e.g., by 5 psi) so that face seal 38 is energized. The through hole of tab 77' may enable gripping by the user to enhance the energizing of face seal 38, for example, by providing a convenient gripping location for the user to hold the closure 30*m* while agitating the beverage inside beverage can 1. To energize face seal 38 during filling, a closing machine may intentionally agitate the beverage inside beverage can 1 to release enough entrapped gas to sufficiently increase the pressure inside beverage can 1.

FIGS. 11A-11D illustrate a fourteenth embodiment of the resealable can end by which the face seal is energized by two dimples included in the center panel. Closure 30*n* actuates in a generally similar manner as closure 30 shown in FIGS. 3A-3D. Base plate 32*n* and top plate assembly 34*n* may be used in place of base plate 32 and top plate assembly 34 shown in FIGS. 2C and 2D.

Base plate 32*n* includes one or more ring portions 86*n*, each ring portion 86*n* lacking an outwardly-protruding bead, rather than a ring 86 including an outwardly-protruding bead 88, as shown, for example, in FIGS. 2C and 2D. When fourteenth embodiment closure 30*n* is in the fully closed position, face seal 38 will be the primary sealing mechanism at any pressure condition. In the fully closed position, curl 22 contacts base plate 32*n* at flange 84 (face seal 38) and bore contact surfaces 90*n*.

Figure 11A:
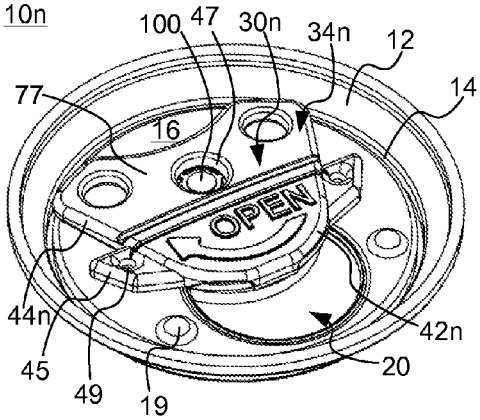
FIG. 11A is a perspective view of a fourteenth embodiment closure assembled onto a can end in the fully open position having a twist cam energized face seal.
Figure 11B:
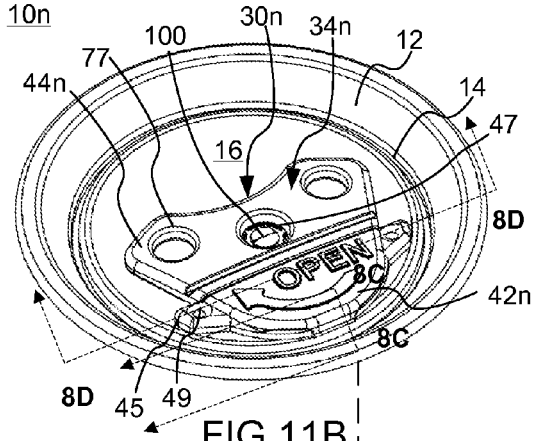
FIG. 11B is a perspective view of the closure depicted in FIG. 11A in the fully closed position.
Figure 11C:
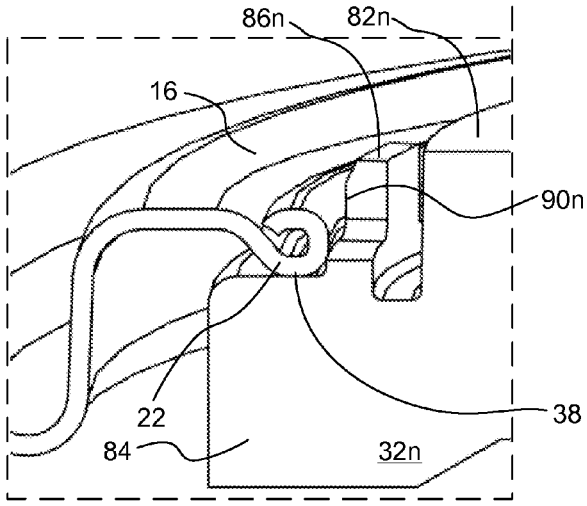
FIG. 11C is an enlarged view of a portion of FIG. 11B depicting a sealing portion of the end.
Figure 11D:
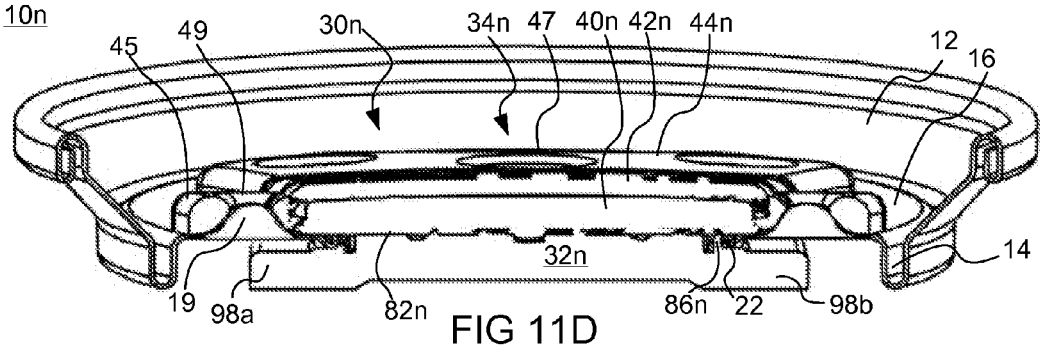
FIG. 11D is a cross sectional view of the closure depicted in FIG. 11B in the fully closed position.

Base plate 32*n* may include any number of ring portions 86*n*. Although as shown in FIG. 11C, base plate 32*n* includes a plurality of ring portions 86*n*, base plate 32*n* may include a single ring or ring portion 86*n*. In such embodiments including a single ring or ring portion 86*n*, the contact area between curl 22 and bore contact surface 90*n* may create a bore seal 36.

Closure 30*n* further includes one or more dimples 19 protruding upward from the top surface of center panel 16, and corresponding dimple depressions 49 located in dimple wings 45 extending from the sides of anchor plate 40*n*. Dimples 19 extend up and away from center panel 16, creating a designed interference with dimple wings 45 when closure 30 is close to the fully closed position, wherein the height of dimples 19 is slightly greater than the vertical separation between dimple wings 45 and center panel 16. Dimples 19 may be any shape, including, for example, circular, oval, square, rectangular, arcuate, or any other shape. Dimple depressions 49 may partially or fully penetrate through dimple wings 45. Dimple wings 45 may be provided without dimple depressions 49.

Dimple depressions 49 may be contoured on the underside of dimple wings 45 to approximately correspond to the shape of dimples 19, so that dimples 19 may self-locate into dimple depressions 49 when closure 30*n* is moved into the fully closed position, and so that when dimples 19 slide into engagement with dimple depressions 49, a user may hear an audible click, which provides an indication to a user that the closure 30*n* has been reclosed and resealed.

When a user begins to open fourteenth embodiment closure 30*n* by moving closure 30*n* to the vented position, the user grasps tab plate 44*n* and rotates tab plate 44*n* as described with reference to FIGS. 3A-3D. This rotation of tab plate 44*n* causes the entire closure 30*n* to rotate, which moves one of wings 98*a* and 98*b* against the underside 15 of end countersink 14, and which disengages dimple depressions 49 from dimple 19, thereby breaking bore seal 38.

To seal closure 30*n* by energizing face seal 38, the user first grips tab plate 44*n* and pulls, slides, or twists closure 30*n* to cover aperture 20. As the user pulls, slides, or twists closure 30*n* or at least top plate assembly 34*n* to cover aperture 20, dimple wings 45 contact side portions of dimples 19. Dimples 19 may be rounded so that the sealing force a user must exert on closure 30*n* gradually increases as dimple wings 45 slide over the top of dimples 19. As dimple wings 45 move over the top of dimples 19, anchor plate 40*n* is pushed slightly up and away from center panel 16, creating a small vertical separation between anchor plate 40*n* and center panel 16. Because base plate 32*n* is coupled to anchor plate 40*n*, the upward pushing of anchor plate 40*n* begins to pull base plate 32*n* up and into engagement with aperture 20.

To continue to seal closure 30*n*, the user continues to pull, slide, or twist closure 30*n* or at least top plate assembly 34*n* into position to cover aperture 20, moving dimple wings 45 over dimples 19 until dimples 19 reach dimple depressions 49. When dimples 19 are aligned with dimple depressions 49, the ring portions 86*n* are aligned with aperture 20, and the upward pulling on base plate 32*n* presses the upper surface of flange 84 against the lower surface of curl 22, thereby energizing face seal 38.

FIGS. 12A-12F illustrate a fifteenth embodiment of the resealable can end by which the face seal is energized by a cam mechanism included in the closure. Closure 30*p* actuates in a generally similar manner as closure 30 shown in FIGS. 3A-3D. Base plate 32*p* and top plate assembly 34*p* may be used in place of base plate 32 and top plate assembly 34 shown in FIGS. 2C and 2D.

Base plate 32*p* includes one or more ring portions 86*p*, each ring portion 86*p* lacks an outwardly-protruding bead, rather than a ring 86 including an outwardly-protruding bead 88, as shown, for example, in FIGS. 2C and 2D. When fifteenth embodiment closure 30*p* is in the fully closed position, face seal 38 will be the primary sealing mechanism at any pressure condition. In the fully closed position, curl 22 contacts base plate 32*p* at flange 84 (face seal 38) and bore contact surfaces 90*p*.

Base plate 32*p* may include any number of ring portions 86*p*. Although as shown in FIG. 12F, base plate 32*p* includes a plurality of ring portions 86*p*, base plate 32*p* may include a single ring portion 86*p*. In such embodiments including a single ring portion 86*p*, the contact area between curl 22 and bore contact surface 90*p* may create a bore seal 36.

Top plate assembly 34*p* includes one or more tongues 52*p* that are configured to mate with one or more catches 92*p* protruding upward from plate member 82*p* of base plate 32*p*. Top plate assembly 34*p* further includes lateral portions 51 positioned on either side of tongue 52*p*. Tongue 52*p* includes a depression 53 for receiving the catch 92*p* when closure 30*p* is in an open position, a cam portion 55 for energizing or releasing the load on face seal 38, and a retaining lip 57 for preventing tongue 52*p* from sliding completely out of catch 92*p*.

Figure 12A:
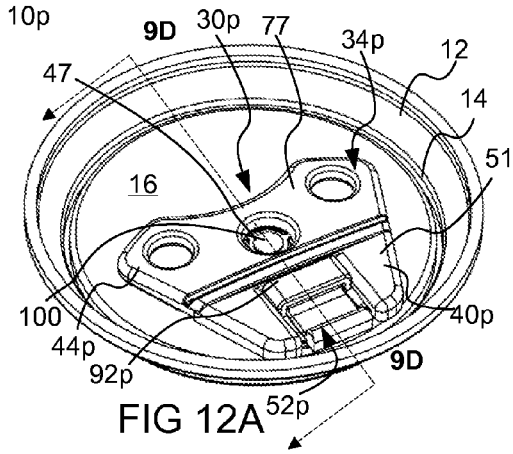
FIG. 12A is a perspective view of a fifteenth embodiment closure assembled onto a can end in the fully closed position having a slide cam energized face seal.
Figure 12B:
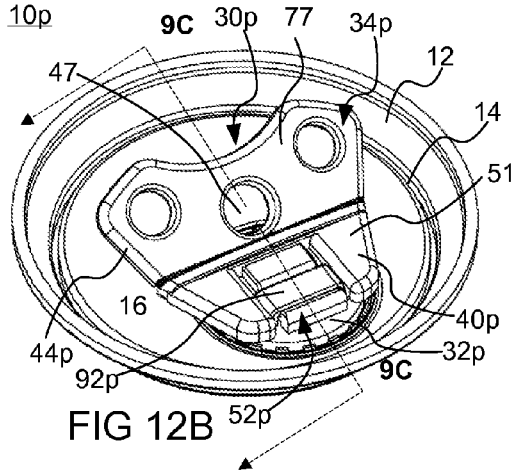
FIG. 12B is a perspective view of the closure depicted in FIG. 12A in a partially open position.
Figure 12C:
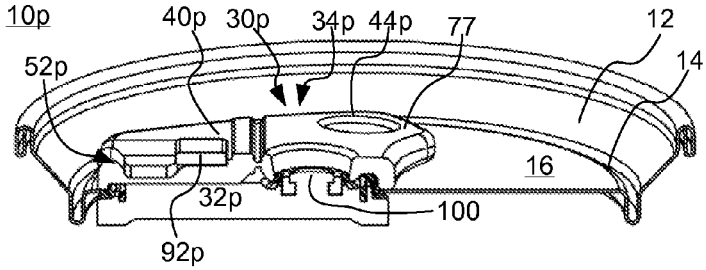
FIG. 12C is a cross sectional view of the closure depicted in FIG. 12A in the fully closed position.

FIGS. 12A and 12C illustrate fifteenth embodiment closure 30*p* in the fully closed position. When closure 30*p* is in the fully closed position, catch 92*p* is located over cam portion 55 of tongue 52*p*. When a user begins to open fifteenth embodiment closure 30*p* by moving closure 30*p* to the vented position, the user grasps tab plate 44*p* and rotates tab plate 44*p* as described with reference to FIGS. 3A-3D. This rotation of tab plate 44*p* causes the entire closure 30*p* to rotate, which moves one of wings 98*a* and 98*b* against the underside 15 of end countersink 14.

Figure 12D:
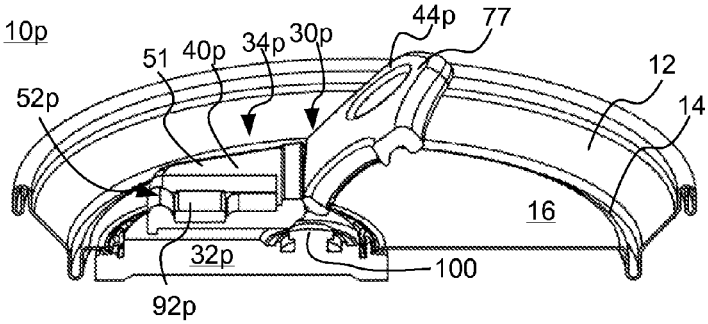
FIG. 12D is a cross sectional view of the closure depicted in FIG. 12B in a partially open position.
Figure 12E:
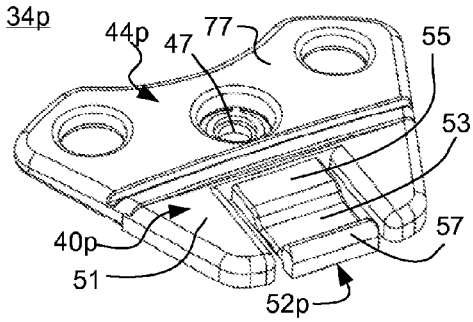
FIG. 12E is a perspective view of a top plate configuration that may be employed with the tenth embodiment closure.
Figure 12F:
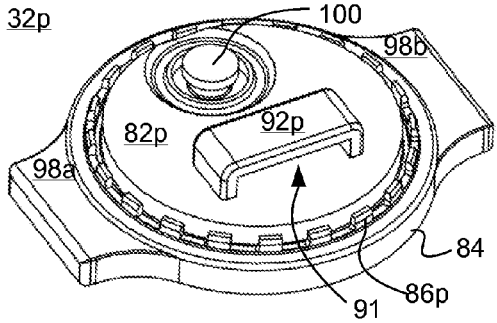
FIG. 12F is a perspective view of a bottom plate configuration that may be employed with the tenth embodiment closure.

To move fifteenth embodiment closure 30*p* to the fully open and operational position, the user continues to grip tab plate 44*p* and pulls or slides top plate assembly 34*p* relative to base plate 32*p* to a partially open position, shown in FIGS. 12B and 12D. When closure 30*p* reaches this partially open position, tongue 52*p* has slid relative to catch 92*p*, such that catch 92*p* is located over depression 53 instead of cam portion 55, and retaining lip 57 contacts catch 92*p* to prevent tongue 52*p* from sliding completely out of catch 92*p*.

Because depression 53 is lower than cam portion 55 (i.e., vertically closer to center panel 16), when depression 53 is slid under catch 92*p*, catch 92*p* moves vertically lower (relative to top plate assembly 34*p* and center panel 16). When catch 92*p* moves vertically lower, the entire base plate 32*p* moves vertically lower, thereby separating the top surface of flange 84 from the bottom surface of curl 22 and releasing the force acting to maintain face seal 38. Once there is no longer force maintaining face seal 38, the user can easily slide closure 30*p* to fully expose aperture 20 to enable drinking or pouring from the can end.

To seal closure 30*p* by energizing face seal 38, the user first grips tab plate 44*p* and pulls or slides closure 30*p* until base plate 32*p* engages aperture 20. After base plate 32*p* engages aperture 20, the user continues to pull tab plate 44*p* to slide tongue 52*p* relative to catch 92*p*. The boundary or transition on tongue 52*p* between depression 53 and cam portion 55 may be chamfered or rounded so that the sealing force a user must exert on closure 30*p* gradually increases as catch 92*p* slides over the top of cam portion 55. As catch 92*p* slides over the top of cam portion 55, catch 92*p* moves vertically higher, and the entire base plate 32*p* moves vertically higher, thereby forcing the top surface of flange 84 against the bottom surface of curl 22 with sufficient force to energize face seal 38.

For embodiments in which the ring 86 has a non-elastomeric bead 88, the action of bead 88 moving over curl 22 may create an audible click, which provides an indication to a user that the closure has been reclosed and resealed. The length, thickness, shape, and material properties may be chosen to enhance this audible click. The inventors notice that the click is louder than expected, and it is believed that center panel 16 acts as a portion of a sound box to amplify the click.

The foregoing description is provided for the purpose of explanation and is not to be construed as limiting the invention. While the invention has been described with reference to several embodiments or several methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Attributes of several of the embodiments are compared with those of other embodiments or the prior art. The explanation of the attributes is not intended to indicate favorability of one embodiment or attribute over another, nor to be limiting in any way. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed:

1. A can end combination, comprising:

a metal can end, the can end including a peripheral wall and a center panel, the center panel including an upper surface, an opposing lower surface, and an edge formed into a curl that defines an aperture through the center panel; and a resealable closure coupled to the can end, the closure including a base plate and a top plate assembly coupled to the base plate, the base plate including a base member and an elastomeric portion having a substantially L-shaped cross-section, the base member being comprised of a thermoplastic material and the elastomeric portion being comprised of an elastomeric material, wherein the elastomeric material is relatively softer than the thermoplastic material, the closure including (i) a sealed position in which the base plate contacts the center panel about the aperture such that the elastomeric portion is at least partially compressed and the curl forms a bore seal, the bore seal disposed within a bore formed by the curl, and a face seal with the elastomeric portion, (ii) an intermediate position in which the base plate is proximate the aperture but the closure is devoid of the bore seal, and the face seal, and (iii) a fully open position in which the aperture is exposed to enable pouring liquid through the aperture.

2. The can end combination of claim 1, wherein the base plate further includes a ring that is at least partially comprised of the elastomeric portion.

3. The can end combination of claim 2, wherein the bore seal is formed by contact between the elastomeric portion and the curl when the closure is in the sealed position.

4. The can end combination of claim 1, wherein the bore seal and the face seal are formed by contact between the elastomeric portion and the curl when the closure is in the sealed position.

5. The can end combination of claim 1, wherein the base plate further includes a flange that is at least partially comprised of the elastomeric portion, and the face seal is formed by contact between the elastomeric portion and the curl when the closure is in the sealed position.

6. The can end combination of claim 1, wherein (i) the base plate further includes a channel disposed radially inward from the elastomeric portion.

7. The can end combination of claim 1 wherein the elastomeric material is silicone.

8. The can end combination of claim 1 wherein the elastomeric material is a thermoplastic elastomer.

9. The can end combination of claim 1 wherein the thermoplastic material is a color other than white.

10. The can end combination of claim 1 wherein the elastomeric portion is coated onto the thermoplastic portion.

11. A can end combination, comprising:

a metal can end, the can end including a peripheral wall and a center panel, the center panel including an upper surface, an opposing lower surface, and an edge formed into a curl that defines an aperture through the center panel; and a resealable closure coupled to the can end, the closure including a base plate and a top plate assembly coupled to the base plate, the base plate including a circumferential flange near its periphery, and a ring extending up from the flange, the ring defining an outboard bead, wherein the circumferential flange of the base plate includes at least a surface that is made of an elastomeric material and the ring of the base plate is made of a thermoplastic, the elastomeric material being softer than the thermoplastic, wherein the closure has (i) a sealed position in which the base plate contacts the center panel about the aperture and the curl forms a face seal with the flange, a bore seal with the ring, the bore seal disposed within a bore formed by the curl, and a bead seal with the ring, (ii) an intermediate position in which the base plate is proximate the aperture but the closure is devoid of the bore seal, the bead seal and the face seal, and (iii) a fully open position in which the aperture is exposed to enable pouring liquid through the aperture.

12. The can end combination of claim 11 wherein the ring includes at least a surface that is made of the elastomeric material.

13. A can end combination, comprising:

a metal can end, the can end including a peripheral wall and a center panel, the center panel including an upper surface, an opposing lower surface, and an aperture that extends through the center panel; and a resealable closure coupled to the can end, the closure including a base plate and a top plate assembly coupled to the base plate, the base plate including a circumferential flange near its periphery, and a ring extending up from the flange, the ring defining and outboard bead, wherein the circumferential flange of the base plate is made of a thermoplastic and the ring of the base plate includes at least a surface that is made of an elastomeric material, the elastomeric material being softer than the thermoplastic, wherein the closure has (i) a sealed position in which the base plate contacts the center panel about the aperture and forms a face seal, a bore seal, and a bead seal, wherein the bore seal disposed within a bore formed by the curl, (ii) an intermediate position in which the base plate is proximate the aperture but the closure is devoid of the bore seal, the bead seal, and the face seal, and (iii) a fully open position in which the aperture is exposed to enable pouring liquid through the aperture.

14. The can end combination of claim 13 wherein the flange includes at least a surface that is made of the elastomeric material.

* * * * *